US006550455B2

(12) United States Patent
Carroll, III et al.

(10) Patent No.: US 6,550,455 B2
(45) Date of Patent: Apr. 22, 2003

(54) CYCLIC PRESSURIZATION INCLUDING PLURAL PRESSURIZATION UNITS INTERCONNECTED FOR ENERGY STORAGE AND RECOVERY

(75) Inventors: John T. Carroll, III, Columbus, IN (US); Donald J. Benson, Columbus, IN (US); Yul J. Tarr, Pune, IN (US); Laszlo D. Tikk, Columbus, IN (US); Taner Tuken, Columbus, IN (US)

(73) Assignee: Cummins Engine Company, Inc., Columbus, OH (US)

( * ) Notice: Subject to any disclaimer, the term of this patent is extended or adjusted under 35 U.S.C. 154(b) by 0 days.

(21) Appl. No.: 10/121,864

(22) Filed: Apr. 15, 2002

(65) Prior Publication Data

US 2002/0108602 A1 Aug. 15, 2002

Related U.S. Application Data

(62) Division of application No. 09/547,713, filed on Apr. 11, 2000.

(51) Int. Cl.[7] ..... F02M 41/00

(52) U.S. Cl. ..... 123/456; 123/508

(58) Field of Search ..... 123/456, 447, 123/506, 508, 467, 468, 469, 446, 514

(56) References Cited

U.S. PATENT DOCUMENTS

| | | | | |
|---|---|---|---|---|
| 4,503,825 | A | | 3/1985 | Schneider |
| 4,622,942 | A | | 11/1986 | Nozaki et al. |
| 4,811,715 | A | | 3/1989 | Kjordjevic et al. |
| 5,094,215 | A | | 3/1992 | Gustafson |
| 5,094,216 | A | | 3/1992 | Miyaki et al. |
| 5,159,911 | A | | 11/1992 | Williams et al. |
| 5,197,438 | A | | 3/1993 | Yamamoto |
| 5,201,294 | A | | 4/1993 | Osuka |
| 5,277,156 | A | | 1/1994 | Osuka et al. |
| 5,311,850 | A | | 5/1994 | Martin |
| 5,404,855 | A | | 4/1995 | Yen et al. |
| 5,443,047 | A | | 8/1995 | Ishiwata et al. |
| 5,535,723 | A | | 7/1996 | Gibson et al. |
| 5,551,398 | A | | 9/1996 | Gibson et al. |
| 5,558,067 | A | | 9/1996 | Blizard et al. |
| 5,676,114 | A | | 10/1997 | Tarr et al. |
| 5,762,033 | A | * | 6/1998 | Rembold et al. ..... 123/25 C |
| 5,771,864 | A | | 6/1998 | Morishita et al. |
| 5,819,704 | A | | 10/1998 | Tarr et al. |
| 6,247,450 | B1 | | 6/2001 | Jiang |
| 6,267,086 | B1 | * | 7/2001 | Dingle et al. ..... 123/25 C |

FOREIGN PATENT DOCUMENTS

| | | |
|---|---|---|
| WO | WO 94/27041 | 11/1994 |

OTHER PUBLICATIONS

SAE Technical Paper Series #960870, Common Rail—An Attractive Fuel Injection System for Passenger Car Dl Diesel Engines, Gerhard Stumpp and Mario Ricco, International Congress ℄ Exposition, Detroit MI, Feb. 26–29–1996.

SAI Technical Paper Series #980803, "A Common Rail Injection System for High Speed Direct Injection Diesel Engines," N. Guerrassi and P. Dupraz, International Congress and Exposition, Detroit, MI, Feb. 23–26, 1998.

* cited by examiner

*Primary Examiner*—Willis R. Wolfe
*Assistant Examiner*—Mahmoud Gimie
(74) *Attorney, Agent, or Firm*—Nixon Peabody LLP; Tim L. Brackett, Jr.

(57) ABSTRACT

A fuel injection system is disclosed for an internal combustion engine that has multiple combustion chambers and a camshaft which cyclically imparts pressurization energy to and recovers pressurization energy from fuel being supplied to the engine. The fuel injection system includes a plurality of unit injectors, a camshaft linkage which simultaneously reciprocates pressurizing plungers of a set of at least two unit injectors and an interconnecting line which allows selective fluid interconnection between fuel pressurization chambers formed within the unit injectors. The interconnection line allows fluid linkage of the volume of fuel which is simultaneously pressurized and depressurized within the interconnected fuel pressurization chambers of a first set of unit injectors.

51 Claims, 16 Drawing Sheets

FIG. 7a

Table 1. Input parmeters.

| Bulk Modulus | Initial Volume | Initial Pressure | Plunger Diameter | Rocker Ratio | Roller Radius | Roller Modulus | Roller Poisson | Cam Radius | Cam Modulus | Cam Poisson | Contact Length | Minimum Concavity | Minimum Convexity |
|---|---|---|---|---|---|---|---|---|---|---|---|---|---|
| B | $V_0$ | $P_0$ | $D_p$ | K | $R_t$ | $E_t$ | $\nu_t$ | $R_{c,min}$ | $E_t$ | $\nu_t$ | L | | |
| MPa | $mm^3$ | MPa | mm | | mm | MPa | | mm | MPa | | mm | mm | mm |
| 1655 | 9000 | 0 | 10 | 1.5 | 22.50 | 2.07E+05 | 0.3 | 32.9692 | 2.07E+05 | 0.3 | 28 | 500 | 10 |

Table 2. Calculated results.

| Cam Angle | Tappet Lift | Fluid Pressure | Cam Curvature | Cam Load | Cam Stress |
|---|---|---|---|---|---|
| $\phi$ | y | P | $\rho$ | F | $\sigma$ |
| deg | mm | MPa | mm | N | MPa |
| 0.00 | 0.00 | 0.00 | 33.73 | 0.00 | 0.00 |
| 0.50 | 0.00 | 0.00 | 39.10 | 0.19 | 4.12 |
| 1.00 | 0.00 | 0.01 | 46.38 | 1.45 | 11.13 |
| 1.50 | 0.00 | 0.04 | 54.77 | 4.82 | 19.75 |
| 2.00 | 0.01 | 0.10 | 63.84 | 11.20 | 29.49 |
| 2.50 | 0.01 | 0.18 | 75.04 | 21.45 | 40.01 |
| 3.00 | 0.02 | 0.31 | 87.22 | 36.33 | 51.23 |
| 3.50 | 0.03 | 0.48 | 100.39 | 56.54 | 63.05 |
| 4.00 | 0.05 | 0.70 | 115.64 | 82.69 | 75.32 |
| 4.50 | 0.07 | 0.98 | 131.31 | 115.29 | 88.06 |
| 5.00 | 0.09 | 1.31 | 146.46 | 154.80 | 101.27 |
| 5.50 | 0.12 | 1.71 | 160.86 | 201.58 | 114.87 |
| 6.00 | 0.15 | 2.17 | 170.85 | 255.93 | 128.97 |
| 6.50 | 0.19 | 2.70 | 179.48 | 318.05 | 143.37 |
| 7.00 | 0.23 | 3.29 | 181.63 | 388.07 | 158.26 |
| 7.50 | 0.27 | 3.96 | 179.74 | 466.04 | 173.54 |
| 8.00 | 0.32 | 4.69 | 183.93 | 552.00 | 188.62 |
| 8.50 | 0.38 | 5.48 | 187.95 | 646.01 | 203.82 |
| 9.00 | 0.44 | 6.35 | 195.14 | 748.18 | 218.91 |
| 9.50 | 0.50 | 7.29 | 202.72 | 858.61 | 234.05 |
| 10.00 | 0.57 | 8.30 | 210.47 | 977.47 | 249.27 |
| 10.50 | 0.65 | 9.38 | 225.14 | 1104.89 | 264.18 |
| 11.00 | 0.73 | 10.53 | 238.74 | 1241.05 | 279.26 |
| 11.50 | 0.81 | 11.77 | 246.94 | 1386.12 | 294.71 |
| 12.00 | 0.90 | 13.07 | 259.46 | 1540.27 | 310.04 |
| 12.50 | 1.00 | 14.46 | 273.21 | 1703.65 | 325.42 |
| 13.00 | 1.10 | 15.93 | 283.46 | 1876.43 | 341.05 |
| 13.50 | 1.20 | 17.47 | 284.38 | 2058.72 | 357.19 |
| 14.00 | 1.32 | 19.10 | 280.87 | 2250.63 | 373.64 |
| 14.50 | 1.43 | 20.82 | 278.64 | 2452.24 | 390.13 |
| 15.00 | 1.55 | 22.61 | 266.02 | 2663.58 | 407.31 |
| 15.50 | 1.68 | 24.49 | 250.85 | 2884.66 | 424.88 |
| 16.00 | 1.82 | 26.44 | 230.06 | 3115.42 | 443.18 |
| 16.50 | 1.96 | 28.48 | 206.55 | 3355.77 | 462.29 |
| 17.00 | 2.10 | 30.60 | 184.68 | 3605.54 | 481.96 |
| 17.50 | 2.25 | 32.80 | 163.12 | 3864.50 | 502.54 |
| 18.00 | 2.40 | 35.08 | 141.98 | 4132.35 | 524.33 |
| 18.50 | 2.56 | 37.42 | 123.78 | 4408.72 | 547.00 |
| 19.00 | 2.73 | 39.84 | 107.36 | 4693.14 | 570.97 |
| 19.50 | 2.89 | 42.31 | 91.29 | 4985.06 | 597.36 |
| 20.00 | 3.06 | 44.85 | 78.19 | 5283.83 | 625.11 |
| 20.50 | 3.24 | 47.44 | 67.36 | 5588.70 | 654.34 |
| 21.00 | 3.41 | 50.07 | 57.19 | 5898.79 | 687.05 |
| 21.50 | 3.59 | 52.74 | 48.27 | 6213.13 | 723.27 |
| 22.00 | 3.77 | 55.43 | 40.56 | 6530.59 | 763.61 |
| 22.50 | 3.96 | 58.14 | 35.31 | 6849.96 | 802.54 |
| 23.00 | 4.14 | 60.86 | 34.27 | 7170.10 | 825.90 |
| 23.50 | 4.32 | 63.58 | 35.08 | 7490.84 | 840.28 |
| 24.00 | 4.50 | 66.31 | 35.32 | 7812.23 | 857.01 |
| 24.50 | 4.68 | 69.05 | 35.45 | 8134.33 | 873.87 |
| 25.00 | 4.86 | 71.79 | 35.77 | 8457.15 | 889.48 |
| 25.50 | 5.05 | 74.53 | 35.84 | 8780.72 | 906.01 |
| 26.00 | 5.23 | 77.29 | 35.70 | 9105.02 | 923.26 |
| 26.50 | 5.41 | 80.04 | 35.74 | 9430.03 | 939.43 |
| 27.00 | 5.59 | 82.81 | 35.71 | 9755.71 | 955.66 |
| 27.50 | 5.77 | 85.58 | 35.44 | 10082.02 | 972.91 |
| 28.00 | 5.96 | 88.35 | 35.17 | 10408.89 | 990.02 |
| 28.50 | 6.14 | 91.13 | 35.10 | 10736.25 | 1005.89 |

| Tappet Lift Maximum | Fluid Pressure Maximum | Cam Load Maximum | Cam Stress Maximum |
|---|---|---|---|
| y | P | F | $\sigma$ |
| mm | MPa | N | MPa |
| 13.50 | 207.45 | 24439.64 | 1776.95 |

1.298 0.8858 0.151571
9 mm lift TESTCAM for m11 plus
engine: fefs
designer: n.l.rye

FIG. 7b

FIG. 8a

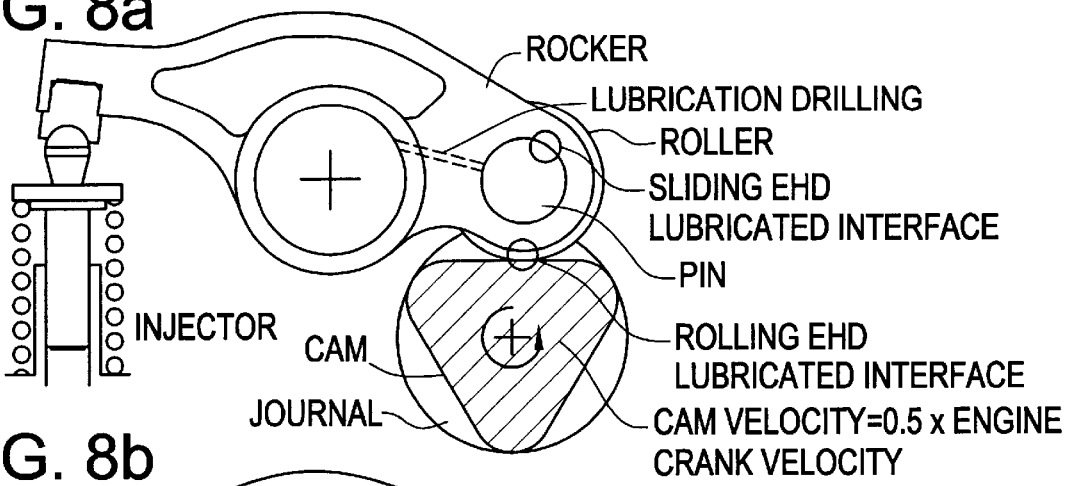

FIG. 8b

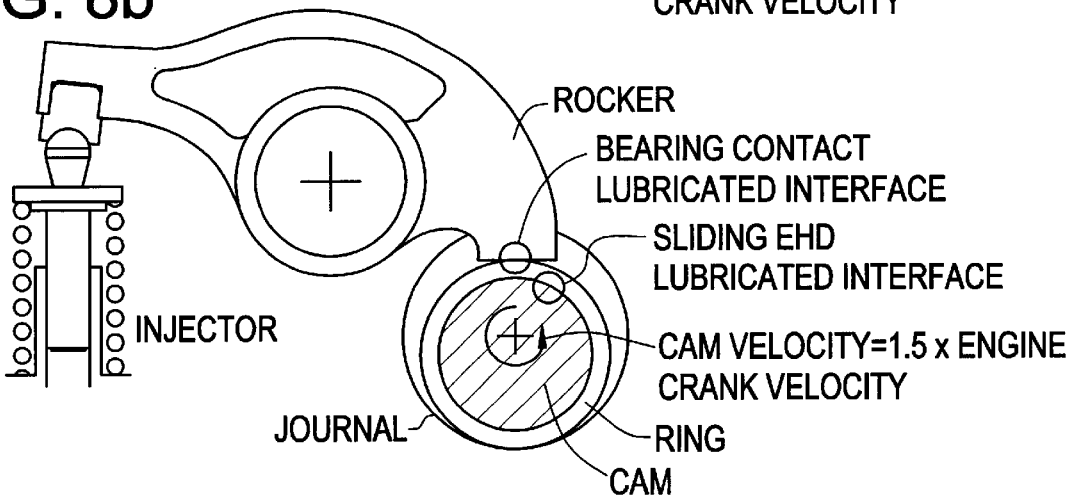

FIG. 9

| FEATURE | TRI-LOBE* | CIRCULAR ECCENTRIC** |
|---|---|---|
| CAM PROFILE FLEXIBILITY | + | - |
| COMBINED VALVE & INJECTOR CAM SHAFT | + | - |
| 1/2 ENGINE VELOCITY DRIVE COMPATIBILITY | + | - |
| SLIDE-OUT CAM SHAFT COMPATIBILITY | + | - |
| PART COUNT | - | + |
| ROCKER INTERTIA | - | + |
| MANUFACTURABILITY | - | + |
| DURABILITY & RELIABILITY<br>-HERTZ STRESS<br>-ROLLING CONTACT FATIGUE<br>-SURFACE FINISH REQUIREMENTS<br>-GRINDER BURN | - | + |

* CAM VELOCITY=0.5 x ENGINE CRANK VELOCITY

** CAM VELOCITY=1.5 x ENGINE CRANK VELOCITY

CYCLIC PRESSURIZATION INCLUDING PLURAL PRESSURIZATION UNITS INTERCONNECTED FOR ENERGY STORAGE AND RECOVERY

RELATED APPLICATION DATA

This application is a division of U.S. application Ser. No. 09/547,713 filed Apr. 11, 2000, entitled "Cyclic Pressurization Including Plural Pressurization Units Interconnected For Energy Storage And Recovery", which is incorporated herein by reference in its entirety.

BACKGROUND OF THE INVENTION

Summary of the Invention

This invention relates to cyclic pressurization systems, such as fuel systems, including cam actuated unit injectors for storage and recovery of fuel pressurization energy.

Background of the Invention

Designers of fuel systems for diesel engines have come under increasing pressure to achieve ever higher standards of emission abatement while also achieving improved fuel efficiency. It is commonly accepted among such designers that the capability to flexibly adjust injection pressure in the 35 to 200 MPa range is desirable to achieve satisfactory reduction of emissions and increased fuel efficiency. In addition, more precise and predictable control on a cycle by cycle basis (i.e., rapid adjustment) will need to be exercised over various aspects of each fuel injection event such as the metering, timing, pressure, and rate of fuel injection including provision for a pilot injection just prior to the main injection event immediately following the main injection event. At the same time, designers are required to consider the costs associated with the development, manufacture and reliability of any new fuel system since such costs can be staggering not just for design and testing but also for the ancillary costs associated with changing existing engine architecture to accept new types of fuel systems.

Within this context, advanced diesel fuel injection systems are evolving to provide greater flexibility and efficiency in both their application and operation. In recent years, the fuel systems industry has focused attention on the development of energy accumulating, nozzle controlled, fuel system concepts that provide engine speed and load independent control over fuel injection timing, pressure, quantity and multiple injection rate shape. This focused attention has lead to the commercialization of several concepts packaged in the general form of a fluid pressurizing pump connected to a hydraulic energy storage device or high pressure common rail (HPCR) connected to one or more electrically operable injector nozzles. An example of this type of system is disclosed in the commonly assigned International PCT Application WO 94/27041. Other examples include Stumpp et. al. "Common Rail—An Attractive Fuel Injection System for Passenger Car DI Diesel Engines," SAE Technical Paper Series, No. 960870; Guerrassi et. al., "A Common Rail Injection System for High Speed Direct Injection Diesel Engines," SAE Technical Paper Series, No. 980803; and Osenga et al. "CAT GEARS Up Next Generation Fuel Systems," Diesel Progress, August 1998, pp. 82–90.

While these prior art approaches are suitable in many ways, they generally require changes in the architecture of the engine. In particular, the adoption of a high pressure common rail system as a substitute for a fuel system including unit injectors can necessitate a complete redesign of the engine head since the space reserved for the unit injectors is now occupied by an electronically controlled nozzle. At the same time, a high pressure pump is required to be located on the engine in a position permitting a drive connection with the engine crankshaft. This arrangement may require redesign of the gear train at one end of the engine and/or a redesigned camshaft. If the camshaft is changed, various cam driven linkages will likely also require modification.

Numerous examples exist of energy accumulating, nozzle controlled, fuel system concepts employing mechanically actuated unit injectors. For example, see U.S. Pat. No. 5,094,215 to Gustafson; U.S. Pat. No. 5,535,723 to Gibson et al.; U.S. Pat. No. 5,551,398 to Gibson et al.; and U.S. Pat. No. 5,676,114 to Tarr et al. (see FIG. 17). In each of these systems, however, the fuel that is pressurized is fluidically isolated within a single pressurization chamber located within each injector. Still other patents, e.g. U.S. Pat. No. 5,676,114 to Tarr et al. and U.S. Pat. No. 5,819,704 to Tarr et al., describe a flexible and efficient fuel system that is compatible with known types of high pressure common rail (HPCR), unit pump, and unit injector physical forms. None of these references, however, suggests joining injectors or synchronizing pumping. In fact, no known fuel system, commercially available, combines the energy storage and pumping capacities of two or more mechanically actuated unit injectors to form a high pressure, high volume fuel system for supplying fuel under the precise control necessary to achieve reduced emissions and improved fuel efficiency.

SUMMARY OF THE INVENTION

A general object of this invention is to provide a fluid pressurizing system that overcomes the deficiencies of the prior art by providing a mechanism including plural mechanically actuated pressurizing units for storing and recovering the energy of pressurization.

Another object of this invention is to provide a fuel system that overcomes the deficiencies of the prior art by providing a mechanism for storing and recovering the energy of fuel pressurization while employing cam actuated unit fuel injectors having dimensional and operating characteristics that permit adoption on existing engines with only minimal changes to the basic architecture of the engine such as the head, cam and injector drive trains.

Another object of this invention is to provide a fuel system that significantly increases the hydraulic energy storage and pumping capacities of mechanically actuated unit injectors that fit within the space provided for more conventional unit injectors.

Still another object of this invention is to provide a fuel system that operates to cyclically impart pressurization energy to and recover pressurization energy from fuel trapped within one or more sets of fluidically linked, synchronously operated unit injectors wherein multiple sets may be operated out of phase of each other by a predetermined angular amount.

Another object of this invention is to provide a fuel system including a plurality of unit injectors wherein each injector has a pressurizing plunger mounted for reciprocation within said bore to form a fuel pressurizing chamber from which fuel may be withdrawn at relatively high pressure for injection into a corresponding combustion chamber of the engine through said injection orifice and wherein a camshaft linkage is provided to synchronously reciprocate the pressurizing plungers of one or more sets of two or more unit injectors as the engine camshaft rotates to impart, pressurization energy to fuel trapped within said fuel pressurizing chambers when said pressurizing plungers advance and to recover pressurization energy from fuel trapped within the fuel pressurizing chambers when the pressurizing plungers retract.

Yet another objective is to provide a fuel system of the type described above including a first interconnecting line for allowing selective fluidic interconnection of the fuel pressurizing chambers formed within a first set of unit injectors to allow fluidic linkage of the volume of fuel being simultaneously pressurized and depressurized within the interconnected fuel pressurizing chambers of a first set of unit injectors, wherein the total volume of fuel that is fluidically linked together within a first set of synchronized unit injectors may be made to substantially exceed the volume of fuel injected during each injection event to avoid substantial loss of injection pressure from the beginning to end of each injection event.

Still another object is to provide a fuel system of the type disclosed above including in association with each set of synchronized unit injectors a first pressure control valve moveable between an open condition in which fuel is allowed to flow in either direction between the source of fuel and the interconnected fuel pressurizing chambers of the set of unit injectors and a closed condition in which energy may be imparted to the fuel within the fuel pressurizing chambers of the set of unit injectors as the corresponding pressurizing plungers are advanced and in which energy may be recovered from the fuel within the fuel pressurizing chambers of a first set of unit injectors as the corresponding pressurizing plungers retract.

Still another object of this invention as described above is to provide a fuel system that may include additional sets of unit injectors with the same capabilities as a first set but are operated out of phase with a first set to allow properly timed fuel injections to occur into each engine combustion cylinder and further including additional interconnecting lines, and synchronized movement of pressurization plungers within the additional sets of unit injectors to cause successive cycles in which pressurization energy is imparted and recovered from a volume of fuel that substantially exceeds the volume of fuel injected during each injection event to avoid substantial loss of injection pressure from the beginning to end of each injection event.

Another object of this invention is to provide a fuel system as described above wherein the pressure control valves and the nozzle control valves associated with sets of unit injectors and unit injectors, respectively, have electromechanical actuators (e.g. solenoid or piezoelectric) and the system includes an electronic control unit electrically connected to the valve actuators to cause the following sequential periods of operation for all unit injectors within a set of unit injectors:

a spilling period when the nozzle control valves are in a closed condition, and the pressure control valve is in an open condition and the pressurizing plungers of the set are advancing, a pressurizing period when the nozzle control valves and the pressure control valve are in closed conditions and the pressurizing plungers of the set are advancing, an injecting period when one nozzle control valve of an associated unit injection is selectively placed in an open condition while all other nozzle control and pressure control valves remain in closed conditions and while the pressurizing plungers of the set are continuing to advance to cause a controlled amount of fuel to be injected into the combustion chamber of the associated unit injector, an over pressurizing period when the nozzle control valves and the pressure control valve are in a closed condition and the pressurizing plungers of the set are continuing to advance, a recovering period when the nozzle control valves and the pressure control valve are in a closed condition and the pressurizing plungers of the set are retracting to cause the pressurization energy to be converted into mechanical energy by the associated plungers and cam shaft lobes, and a filling period when the nozzle control valves are closed and the pressure control valve is open and the pressurizing plungers are retracting.

Still further, it is an object of the subject invention to provide pressure control signals and nozzle control signals generated for the unit injectors of either of the first or second sets to cause the following sequential periods of operation for each unit injector independent of the operation of the other unit injectors within that set of unit injectors:

a pilot injecting period when the nozzle control valve of a unit injector in one set is in an open condition and the pressure control valve for that set is in a closed condition, and the pressurizing plunger for that unit injector is advancing at a predetermined time in advance of the desired main injection event, a dwelling period when both the nozzle control valve of an injector in one set and the pressure control valve for that set are in a closed condition and the pressurizing plunger for that unit injector is continuing to advance, a low-flow main injecting period when the nozzle control valve of a unit injector in one set is in an open condition and the pressure control valve for that set is in a closed condition and the pressurizing plunger for that unit injector is continuing to advance, and a high-flow main injecting period when the nozzle control valve of a unit injector in one set is in an open condition and the pressure control valve for that set is in a closed condition and the pressurizing plunger for that unit injector is continuing to advance.

Another object of this injection is to provide a fuel system as described above wherein the nozzle control valve of a unit injector can be re-opened to inject an additional amount of fuel following a main injection event while the pressurizing plunger for that unit injector is continuing to advance.

Another object of this invention is to provide a fuel system as described above wherein the low-flow main injection period is initiated at a predetermined point in time during the advance of the corresponding pressuring plunger. The predetermined point in time is selected so that sufficient pressure can be attained just prior to the point at which low-flow main injection is desired.

It is yet another object of this invention to provide a second embodiment of the invention in which a fuel system is provided generally as described above except that the single pressure control valve per set is replaced with a plurality of pressure control valves associated, respectively, with each unit injector of that set. In other words, each unit injector of a set includes its own dedicated pressure control valve. Each pressure control valve has an open condition in which fuel is allowed to flow in either direction between the source of fuel and the corresponding fuel pressurizing chamber of the unit injector and a closed condition in which no fuel is allowed to flow. Each unit injector also includes a shuttle valve having a closed condition in which fuel is prevented from flowing from the corresponding fuel pressurizing chamber into the corresponding interconnecting line whenever the pressure within the corresponding fuel pressurizing chamber is less than the pressure within the interconnecting line and an open condition in which fuel is allowed to flow from the corresponding fuel pressurizing chamber into the interconnecting line The fuel system further includes an electronic control unit for generating the pressure control signals and the nozzle control signals necessary to achieve desired periods of operation. Because each unit injector has its own pressure control valve and shuttle valve, the electronic control unit is able to independently control the timing, rate, quantity and pressure of a separate pilot and main injection from each unit injector within a first set and additional sets. For example, the pumping capacity of two unit injectors in a set may be combined to increase the rate of pressure rise and the fuel delivery rate of one injection event, while a third unit injector is caused to spill fuel to the supply.

It is still another object of this invention to provide a second embodiment as described above wherein the pressure control signals and the nozzle control signals generated for the unit injectors of a first set and additional sets of unit injectors cause the following independent sequential periods of operation for each unit injector:

- a spilling period when the nozzle control valve is in a closed condition, the pressure control valve is in an open condition and the pressurizing plunger is advancing,
- a pressurizing period when the nozzle control valve and the pressure control valve are both in closed conditions and the pressurizing plunger is continuing to advance,
- a pilot injecting period when the nozzle control valve is in an open condition and the pressure control valve is in a closed condition, and the pressurizing plunger is continuing to advance,
- a dwelling period when both the nozzle control valve and the pressure control valve are in a closed condition and the pressurizing plunger is continuing to advance,
- a low-flow main injecting period when the nozzle control valve is in an open condition and the pressure control valve is in a closed condition and the pressurizing plunger is continuing to advance,
- a high-flow main injecting period when the nozzle control valve is in an open condition and the pressure control valve is in a closed condition and the pressurizing plunger is continuing to advance,
- an over pressurizing period when both the nozzle control valve and the pressure control valve are in a closed condition and the pressurizing plunger is continuing to advance,
- a recovering period when the nozzle control valve is closed and the pressure control valve is closed and the pressurizing plunger is retracting, and
- a filling period when the nozzle control valve is closed and the pressure control valve is open and the pressurizing plunger is retracting.

Another object of this invention is to provide a fluid pressurizing system for cyclically imparting pressurizing energy to, and recovering energy from, a fluid by means of a plurality of interlinked pressurizing units such as units that would be used, for example, to hydraulically actuate intake and exhaust valves for an internal combustion engine or to operate material fatigue test equipment.

Yet another object of this invention is to provide a pressure activated, latching, hydraulic valve with externally referenced reset pressure. In particular, it is an object to provide a shuttle valve to operate in response to the relative magnitude of three separate fluid pressures including $P_p$ which in the pressure of fluid within a corresponding fuel pressurizing chamber, $P_l$ which is the pressure of fluid in an interconnecting line to which the shuttle valve is connected and $P_m$ which is a reference pressure supplied from a source of reference pressure and further wherein the valve may operate in one of four states, including: (1) a line pressurization state in which $P_m<P_p<P_l$ when the shuttle valve is closed, (2) a reset state in which $P_r=P_p=P_l$ and the shuttle valve is closed, (3) a energy storage state in which $P_m<P_l<P_p$ and the shuttle valve is open, and (4) a energy recovery state in which $P_m<P_p<P$ and the shuttle valve is open. It is within the objects of this invention for the valve to take different structural forms in order to achieve the functions described above.

Still other and more detailed objects, features and advantages of the invention may be understood by considering the following Summary of the Drawings and Detailed Description of the Preferred Embodiments.

SUMMARY OF THE DRAWINGS

FIGS. 7*a* and 7*b* are tables demonstrating that a cam suitable for the present invention may be formed without exceeding recognized limits in cam performance guidelines.

FIGS. 8*a* and 8*b* are side elevational views of different types of cam profiles suitable for use in combination with cam drive linkages for imparting reciprocatory motion to a unit injector plunger.

FIG. 9 is a chart comparing the relative advantages of the different cam profiles illustrated in FIGS. 8*a* and 8*b*.

DETAILED DESCRIPTION OF THE INVENTION

The subject invention relates to a high pressure fuel system for directly injecting fuel into the combustion cylinders of a compression ignition engine at carefully controlled times, at very high pressures (e.g. 200 MPa), in carefully controlled amounts, and at flow rates that are designed to allow the engine to achieve levels of fuel efficiency and emission abatement that have heretofore been difficult to achieve without requiring major redesign of prior art engine architecture. More particularly, the disclosed invention allows engines equipped with cam driven unit injectors to meet more easily the requirements for higher fuel efficiency and emission abatement demanded by government mandate and economic competition.

Figure 1:
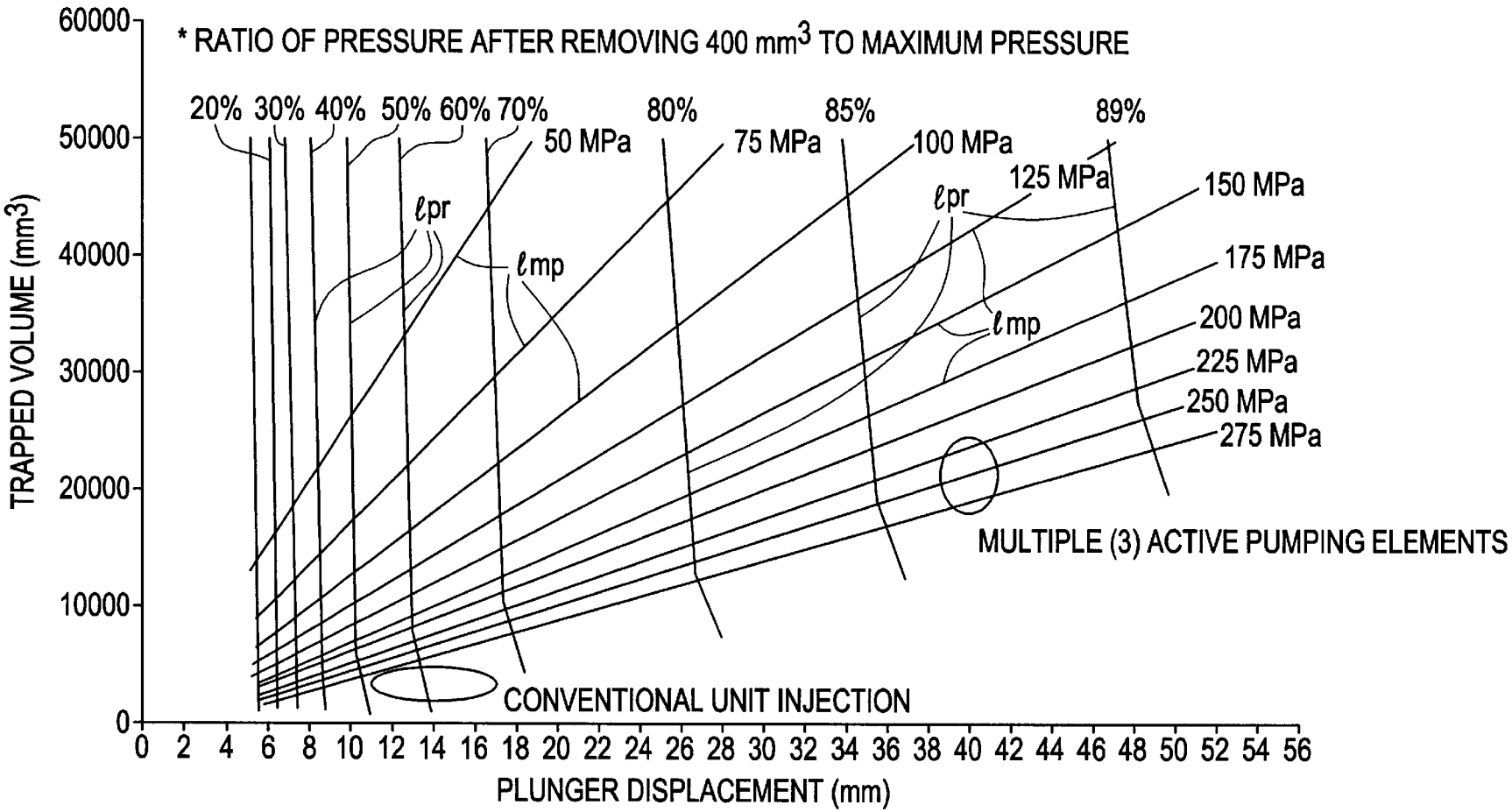
FIG. 1 is a graph relating the effect, in terms of reduced pressure, upon removal of a fixed quantity of fuel from a trapped volume of varying size plotted along the vertical-axis and a plunger displacement of varying amounts plotted along the horizontal axis.

The disclosed invention increases the hydraulic energy storage and pumping capacities of mechanically actuated unit diesel injection systems by fluidically connecting a common high-pressure interconnecting line to the fuel pressurizing chambers formed by the fuel pressurizing plungers of two or more unit injectors and by synchronizing their mechanical actuation. FIG. 1 contains lines $l_{pr}$ of predicted constant fuel injection pressure ratio and maximum injection pressure $l_{mp}$ plotted versus trapped volume V and the displacement D of a reference diameter plunger. Injection pressure ratio is defined as the pressure at the conclusion of a reference fuel injection event divided by the pressure at the beginning. Pressure ratios approaching a preferred value of one are observed in conventional high-pressure common rail (HPCR) fuel systems (such as disclosed in PCT International Publication No. WO 94/27041) where trapped volumes are on the order of 50,000 $mm^3$. Direct applications of HPCR energy accumulating operating principles to mechanically actuated unit injectors having 1/10th as much trapped volume result in unsatisfactory pressure ratios of 60% or less. Constraints to the packaging of mechanically actuated unit injectors oppose straightforward efforts to increase trapped volume. In particular, increases in the radial dimension of the plunger diameter is complicated by the fact that the wall thickness surrounding the fuel pressurizing chamber of the unit injector must also be increased to provide sufficient strength to contain the increased outward force imposed on the surrounding wall. This combined requirement for increased radial dimension conflicts with the space needed within the head for coolant flow passages, internal fuel rails for supplying and draining fuel, and needed for accommodating valve stems and valve actuating drive trains above the engine head. Increased height is extremely undesirable as it would require added height to the assembled engine. Additional constraints, placed on maximum cam displacement and injector actuated load, oppose straightforward efforts to increase volumetric displacement for maximum injection pressure even if it were possible, dimensionally, to increase trapped volume.

First Embodiment

FIGS. 2*a* through 2*d* illustrate the first of two embodiments of the invention as it could be applied to a conventional in-line six-cylinder engine having a cylinder firing order of 1-5-3-6-2-4. More particularly, these FIGS. show a fuel system 2 including a first set 4 (bank 1) of three unit injectors 6, 8, 10 and a second set 12 (bank 2) of three unit injectors 14, 16, 18. Each unit injector is operated by single camshaft 20 rotating at one half times the speed of the engine's crank shaft (not illustrated). Actuating the unit injectors 6, 8, and 10 are individual three-lobed cams 22 phased to simultaneously actuate corresponding unit injectors simultaneously every 120 cam degrees. Similarly, cams 24 are arranged to actuate unit injectors 14, 16, and 18, respectively. The two sets of cams are set 60 cam degrees out of phase of each other. Each unit injector includes a body 25 containing a bore for receiving a fuel pressuring plunger 26 for reciprocation within the bore to form a fuel pressurizing chamber 27. Each unit injector also includes a nozzle control valve 28 and a nozzle 30. The fuel pressurizing chambers 27 of the unit injectors of set 4 are joined by a first interconnecting line 32 to low-pressure (e.g., 1 MPa) fuel supply (not illustrated) through a pressure control valve 34. Similarly, the fuel pressurizing chambers 27 of the unit injectors of set 12 are also joined by a second interconnecting line 36 to the low-pressure fuel supply through pressure control valve 38.

As will be explained in more detail below, fuel system 2 operates to cyclically impart pressurization energy to, and recover pressurization energy from, fuel supplied to the engine. More particularly, the fuel system includes a camshaft linkage 40 extending between each cam and the corresponding pressurizing plunger for reciprocating synchronously as the engine camshaft rotates to impart selectively pressurization energy to fuel trapped within the fuel pressurizing chambers when the pressurizing plungers advance and to recover pressurization energy from fuel trapped within the fuel pressurizing chambers when the pressurizing plungers retract. Camshaft linkage 40 may take a variety of forms depending on the relative location of the camshaft and the respective unit injectors and may include a connecting rod, rocker arm and link all of which are not illustrated. The interconnecting lines 32 and 36 allow selective fluidic interconnection of the fuel pressurizing chambers formed within the respective sets of unit injectors to allow fluidic linkage of the volumes of fuel being simultaneously pressurized and depressurized within the interconnected fuel pressurizing chambers of each set of unit injectors. By this arrangement, the total volume of fuel that is fluidically linked together within each set of synchronized unit injectors substantially exceeds the volume of fuel injected during each injection event to avoid substantial loss of injection pressure during each injection event.

Figure 2A:
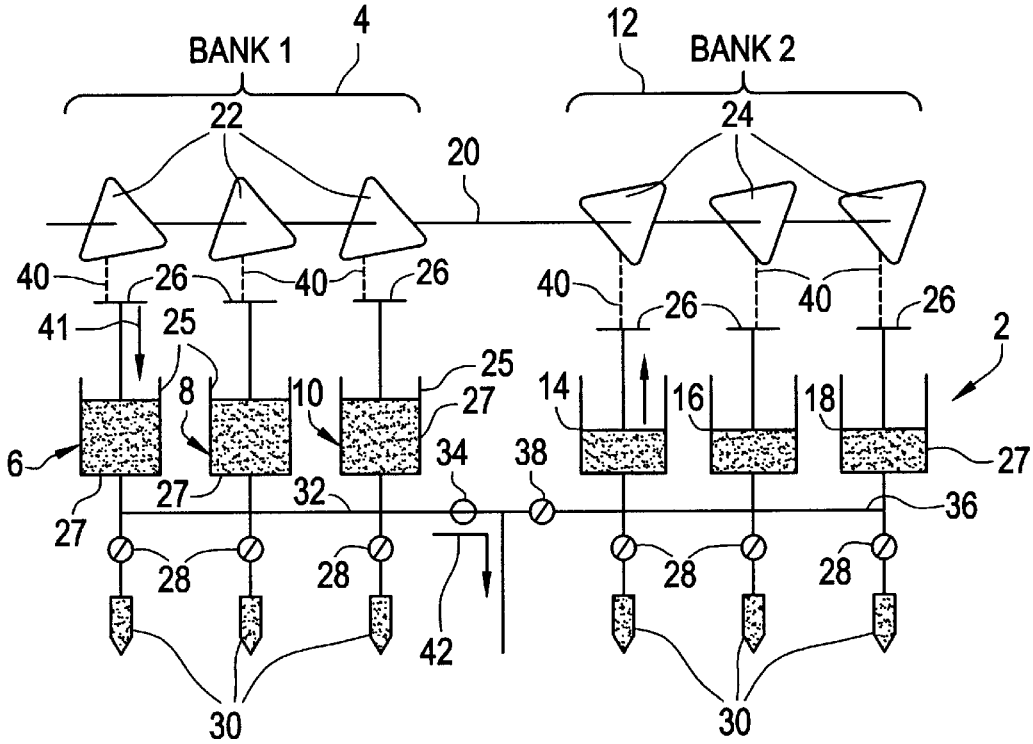
FIGS. 2*a* through 2*d* are schematic diagrams of the cams, unit injectors and control valves of a fuel system designed in accordance with the subject invention.
Figure 2B:
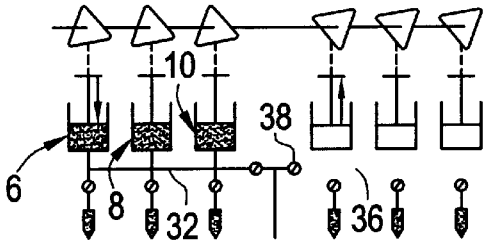
Figure 2C:
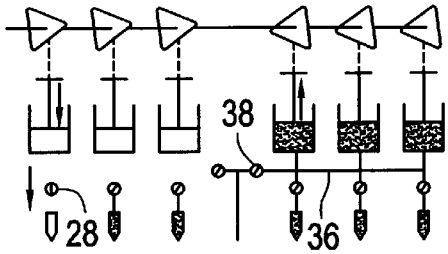
Figure 2D:
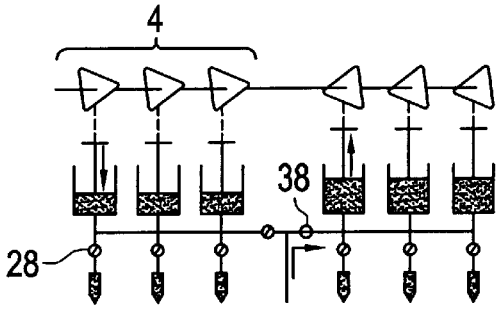

The fuel system 2 operating cycle begins with the plungers 26 of the set 4 of unit injectors 6, 8, 10 advancing (arrow 41) to cause spilling of fuel (arrow 42) at low pressure to the fuel supply through the normally open pressure control valve 34 (FIG. 2*a*). Closing pressure control valve 34 interrupts the spilling process and initiates the pressurization of the injectors and common high-pressure interconnecting line 32 (FIG. 2*b*). A normally closed nozzle control valve 28 is opened to produce a fuel injection event (FIG. 2*c*). Examples of suitable nozzle control valves are illustrated in commonly assigned application Ser. No. 09/371,273 filed Aug. 10, 1999 entitled Fuel Injector Nozzle Assembly With Feedback Control. Additional pressurization of the injectors and common high-pressure interconnecting line occurs when the injection event concludes by closure of nozzle control valve 28 but before the fuel pressurizing plungers 26 of set 4 unit injectors reach points of maximum volumetric displacement (FIG. 2*d*). A pressure relief valve (not shown) can be used to limit maximum pressure during this phase of operation.

Once the unit injectors of set 4 reach the points of maximum volumetric displacement, the energy storage and delivery phases of their operation are completed and the energy recovery phase can begin. Since the operating cycles of set 4 and set 12 are perfectly out of phase with each other, the recovery can be observed in set 12 of FIGS. 2*a* through 2*d*.

Figure 3:
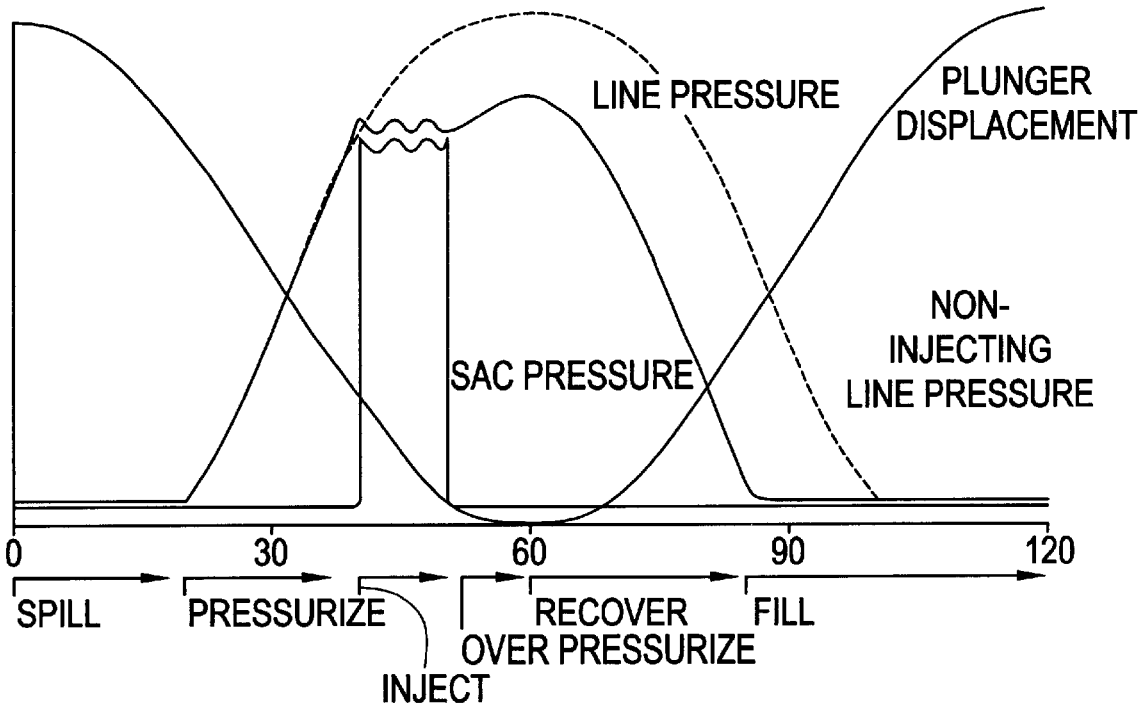
FIG. 3 is a graph relating plunger displacement, line pressure, sac pressure and non-injecting line pressure versus cam angle for a unit injector designed and operated in accordance with the subject invention.

Referring again to FIG. 2*a*, the operating cycle continues with the pressurization of fuel within the set 12 injectors and common high-pressure interconnecting line 36 expanding against the fuel pressurizing plungers 26. The energy released by the expansion is recovered by the camshaft (FIGS. 2*a*, 2*b* and 2*c*). Energy recovery continues until a pressure balance is achieved with the fuel supply at which time, the pressure control valve 38 opens and the fuel supply replaces fuel removed from the system during the operating cycle (FIG. 2*d*). The entire sequence of spilling, pressurizing, injecting, over pressurizing, recovering, and filling is illustrated for a single set of injectors by the hypothetical plunger displacement, line pressure, and sac pressure responses plotted in FIG. 3.

Figure 4:
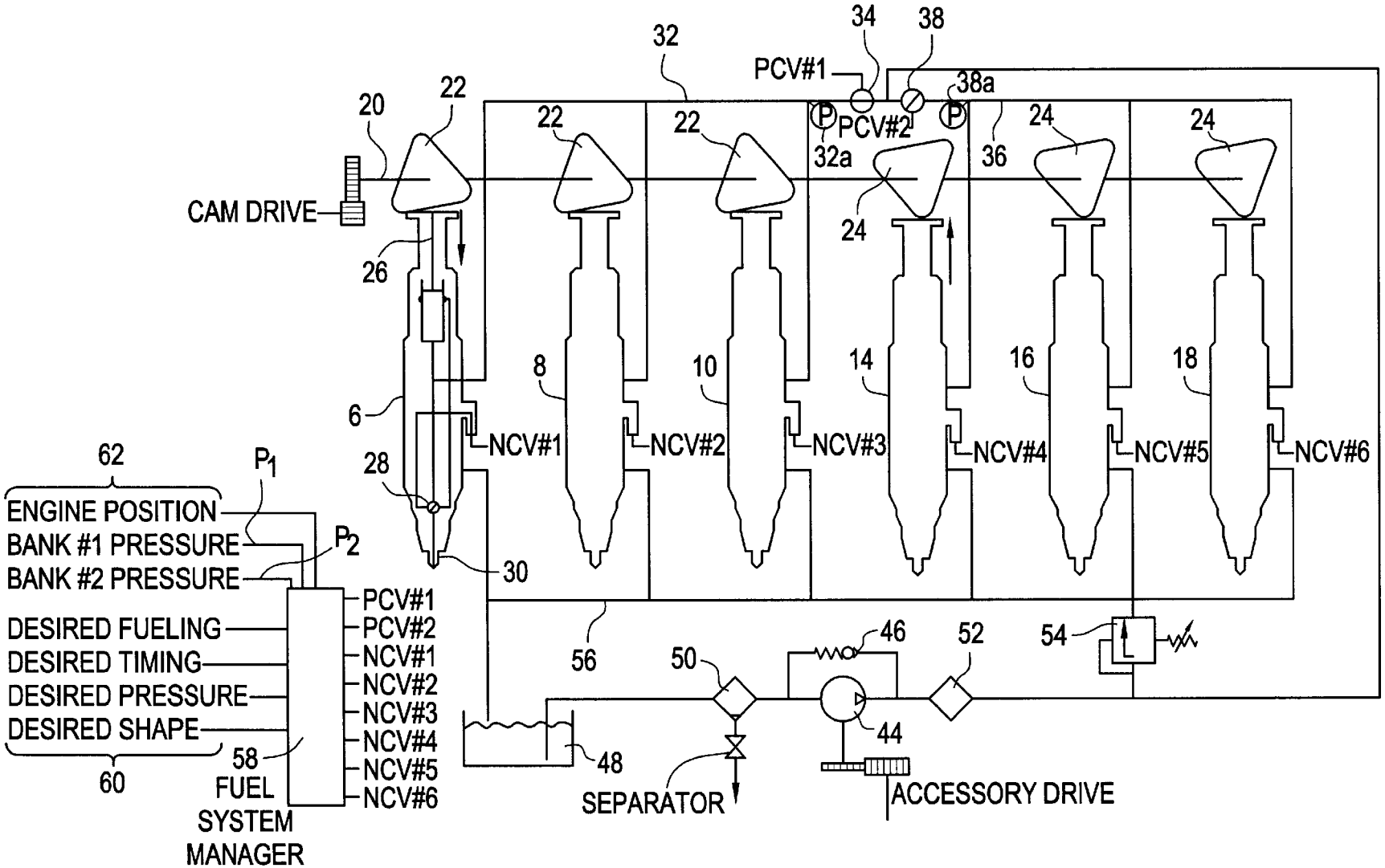
FIG. 4 is a schematic diagram of a fuel system designed in accordance with the subject invention including a electronic control unit for generating the necessary control signals.

FIG. 4 contains a system schematic of the first embodiment. Starting at the bottom center and moving counterclockwise, an engine driven, low pressure, fuel pump 44 with safety relief valve 46 draws fuel from a tank 48 through a combination filter and water separator 50. The discharged fuel is passed through an additional filter 52. The fuel is pressure regulated by a pressure regulator 54 and is supplied to the pressure control valves 34 and 38 serving the two sets of unit injectors through interconnecting lines 32 and 36. A camshaft 20 fitted with three-lobe cams 22 and 24 is driven at one half engine crank speed to mechanically actuate unit injectors 6, 8, 10 and 14, 16, 18 each including a fuel pressurizing plunger 26, a nozzle control valve 28, and nozzle 30. The rotational position of the cam relative to that of the engine crank shaft can be adjusted for optimal phasing of pressurization to the injection window by means not illustrated. Finally, each unit injector is provided with a low-pressure return line 56 to tank.

Pressure insensitive plunger and barrel operating clearance for high pressure, low leakage, applications as disclosed in commonly assigned U.S. Pat. No. 5,899,136 issued May 4, 1999 and nozzle based fuel injection rate control apparatuses and methods can be directly applied to this embodiment of the invention to reduce leakage and to provide additional fuel injection rate control flexibility, respectively.

A fuel system manager in the form of an electronic control unit in the lower left corner accepts desired injected fueling, timing, pressure, and rate shape commands 60 from a combustion manager (not illustrated). It also accepts fuel system specific sensor input 62 such as engine crankshaft position and pressure signals from sensors 32*a* and 38*a* connected with interconnecting lines 32 and 38, respectively. It responds to the inputs by operating the pressure and nozzle control valves 34 and 38 to produce the intended response. Computer implemented control methods for a hydraulically actuated, cyclic energy accumulating, fuel system, can be directly applied to this embodiment of the invention to provide closed loop pressure and fueling controls, and to estimate static timing error, system bandwidth, and effective bulk modulus.

Figure 5:
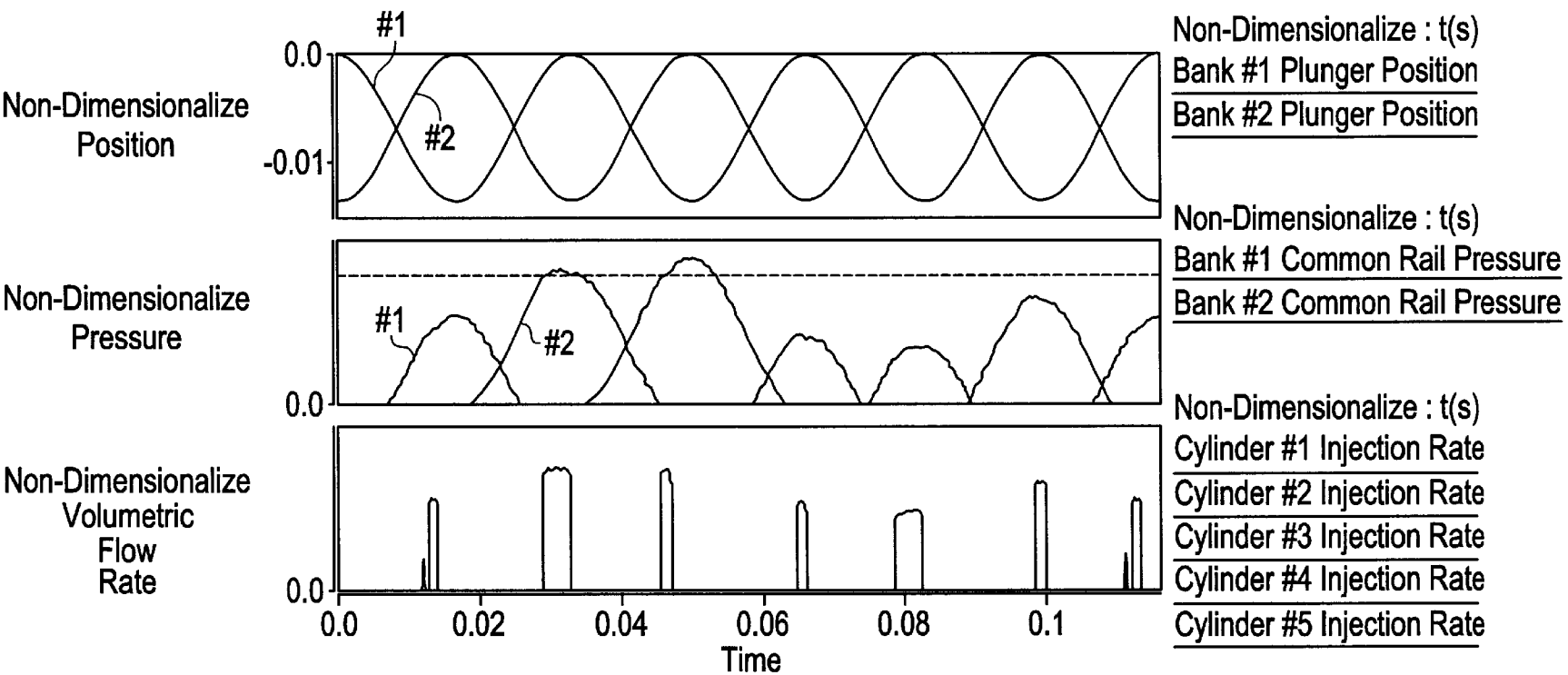
FIG. 5 is a graph illustrating three traces relating plunger position, common rail (interconnecting line) pressures and fuel injection rates for various cylinders versus time for a system designed in accordance with the subject invention.
Figure 6:
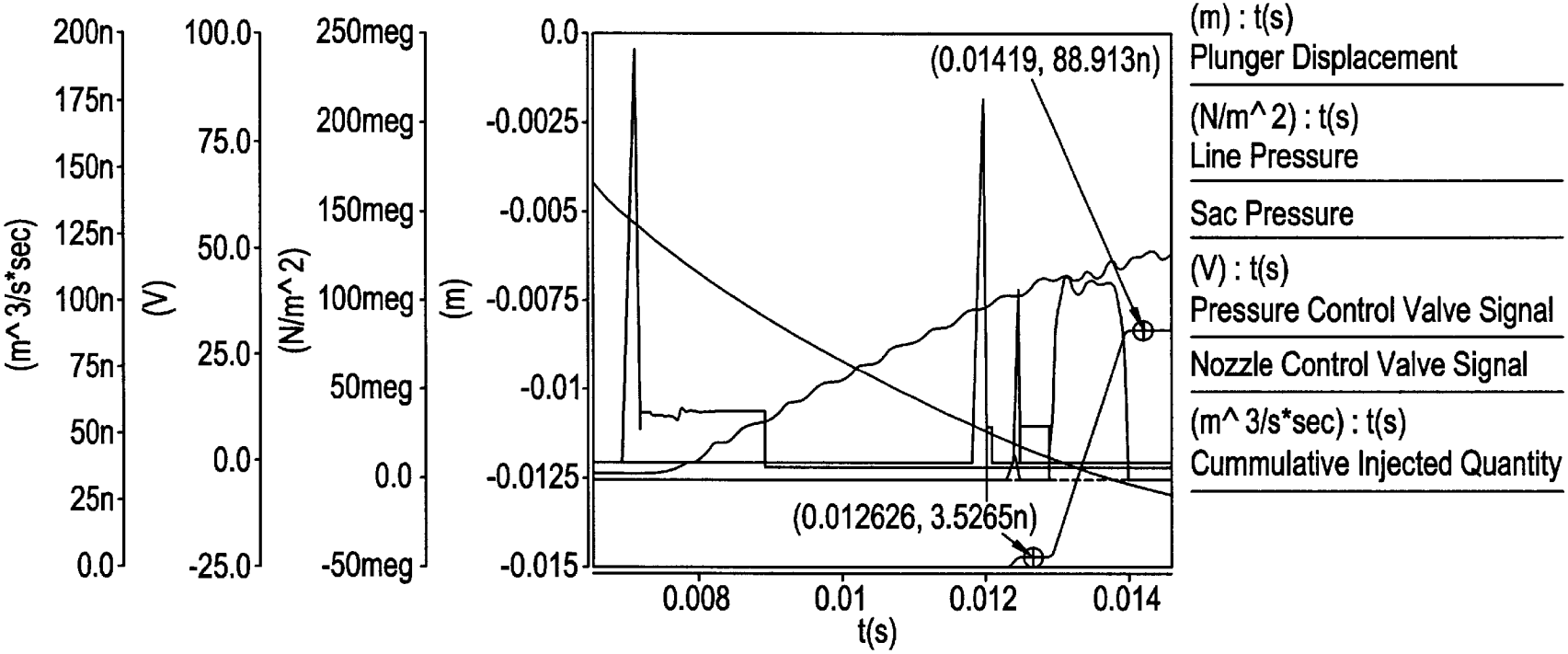
FIG. 6 is a graph relating pressure control valve voltage, plunger displacement, line pressure, sac pressure, cumulative volume of injected fuel and nozzle control valve voltage versus time.

FIGS. 5 and 6 contain results of a hydro-mechanical simulation demonstrating unit injector based fuel injection timing, pressure, rate shape, and quantity control functionality and performance consistent with a previously documented needle controlled fuel system with cyclic pressure generation. Tarr, Y. J., J. D. Crofts, J. T. Carroll, III, and L. D. Tikk, Needle Controlled Fuel System with Cyclic Pressure Generation, U.S. Pat. No. 5,676,114; Tarr, Y. J., J. D. Crofts, J. T. Carroll, III, and L. D. Tikk, Needle Controlled Fuel System with Cyclic Pressure Generation, U.S. Pat. No. 5,819,704. The simulation assumed a typical cam displacement fuel pressurizing plunger stroke, fuel pressurizing plunger diameter, individual injector trapped volume, and interconnecting line volume. The results of a separate cam design exercise confirmed that the assumed cam is compatible with existing manufacturing equipment and processes, existing camshaft geometrical envelopes, injector train displacement multiplication ratios and loads, and material stress limits.

For example, the pressure control signals and the nozzle control signals generated for the unit injectors of the first and second sets—illustrated in FIG. 4—can be arranged to cause the following independent sequential periods of operation for each unit injector of the first and second set of unit injectors:

- a spilling period when the nozzle control valves are in a closed condition, and the pressure control valve is in an open condition and the pressurizing plungers of the set are advancing,
- a pressurizing period when the nozzle control valves and the pressure control valve are in closed conditions and the pressurizing plungers of the set are advancing,
- an injecting period when one nozzle control valve of an associated unit injector is selectively placed in an open condition while all other nozzle control and pressure control valves remain in closed conditions and while the pressurizing plungers of the set are continuing to advance to cause a controlled amount of fuel to be injected into the combustion chamber of the associated unit injector.
- an over pressurizing period when the nozzle control valves and the pressure control valve are in a closed condition and the pressurizing plungers of the set are continuing to advance,
- a recovering period when the nozzle control valves and the pressure control valve are in a closed condition and the pressurizing plungers of the set are retracting to cause the pressurization energy to be converted into mechanical energy by the associated plungers and cam lobes, and
- a filling period when the nozzle control valves are closed and the pressure control valve is open and the pressurizing plungers are retracting.

FIGS. 8*a* and 8*b* illustrate an opportunity presented by the invention to modify a conventional unit injector actuation approach to reduce part count, improve high-speed operation, reduce manufacturing cost, and to improve durability and reliability. In particular, the cam of FIG. 8*a* includes a three lobed profile as illustrated in FIGS. 2*a*–2*d*, and 4 wherein the camshaft rotates at one half the speed of the crankshaft. This arrangement is suitable whenever the unit injector cams are mounted on the same shaft as the cams for operating the respective intake and exhaust valves. Alternatively, a separate camshaft may be used to operate the unit injectors in which case, the camshaft can be operated at 1.5 times the crankshaft velocity to allow the cam profile to assume a more easily formed circular configuration. FIG. 9 is a chart recording the relative advantages of each of the cam arrangements of FIGS. 8*a* and 8*b*. The tri-lobe embodiment of FIG. 8*a* provides greater cam profile flexibility, the advantage of being able to combine the valve and injector cams onto the same camshaft, ½ engine velocity drive compatibility and slide-out camshaft installation and removal. None of these advantages is achievable through use of the circular cam profile embodiment of FIG. 8*b* but this second embodiment has the advantage of providing a reduced part count, reduced rocker inertia, easier manufacturability, and increased durability and reliability.

Second Embodiment

Figure 10A:
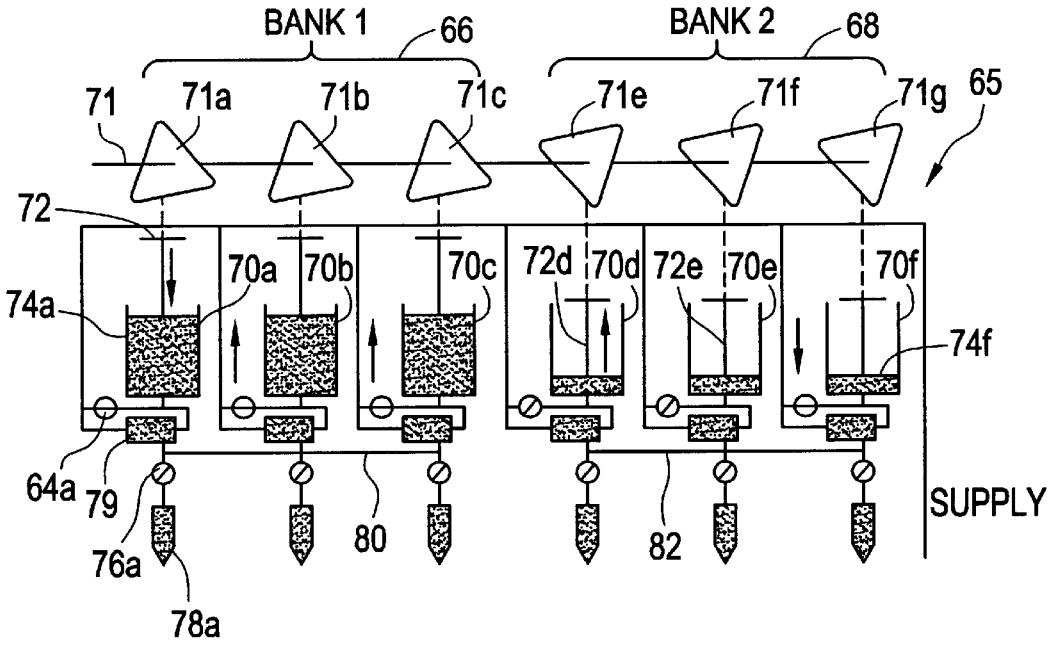
FIGS. 10*a* thru 10*g* are schematic diagrams of the cams, unit injectors and control valves of a fuel system designed in accordance with a second embodiment of the subject invention including a separate pressure control valve for each unit injector.

In the first embodiment of the invention, a single pressure control valve 34 or 38 was used to control the injection pressure for each corresponding set of injectors. This arrangement dictates that all unit injectors within any one set be simultaneously experiencing either the spill or pressurization of fuel. In a second embodiment of the invention, illustrated in FIGS. 10*a* through 10*g* as fuel system 65, each unit injector 70 includes its own dedicated pressure control valve 64 to provide the flexibility to control the various unit injectors within a set to spill and pressurize fuel in various combinations and at various times relative to each other. FIG. 10*a* illustrates this second embodiment of a fuel system 65 designed in accordance with the invention as it might be applied to a conventional in-line six-cylinder engine having a firing order of 1-5-3-6-2-4. FIG. 10*a* shows two sets 66 and 68 of three unit injectors 70*a* through 70*c* and 70*d* through 70*f* each operated by single camshaft 71 rotating at one half times engine crank velocity. Within each set, individual three-lobed cams 71*a* through 71*f* are phased to simultaneously actuate corresponding unit injectors every 120 cam shaft degrees, respectively. The two sets are set 60 cam degrees out of phase of each other. Each unit injector 70 includes a fuel pressurizing plunger 72 forming a fuel pressurizing chamber 74, a pressure control valve 64, a nozzle control valve 76, and a nozzle 78. Each unit injector further includes a shuttle valve 79, the function of which will be explained more fully below. The unit injectors 70 within sets 66 and 68 are joined by high-pressure interconnecting lines 80 and 82, respectively. Each injector's fuel pressurizing chamber 74 is connected to a low pressure (e.g., 1 Mps) fuel supply (not illustrated) through its associated pressure control valve 64.

Figure 10B:
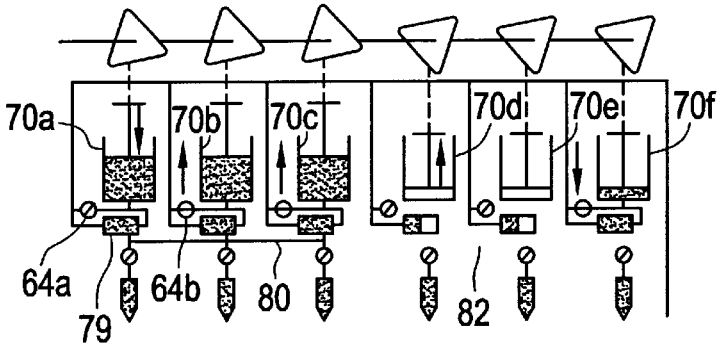
Figure 10C:
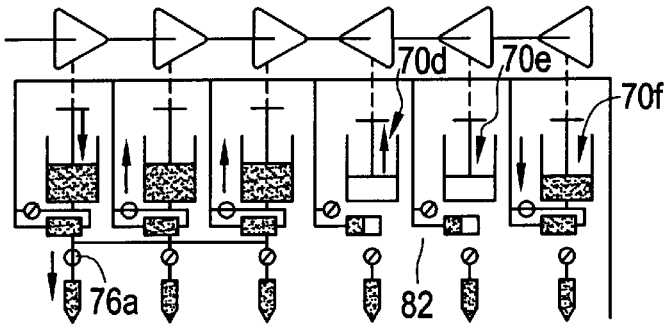
Figure 10D:
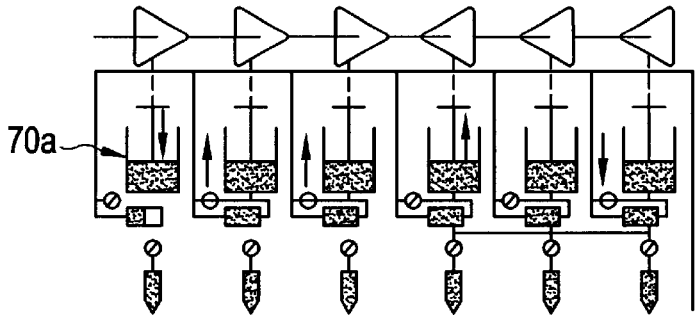
Figure 10E:
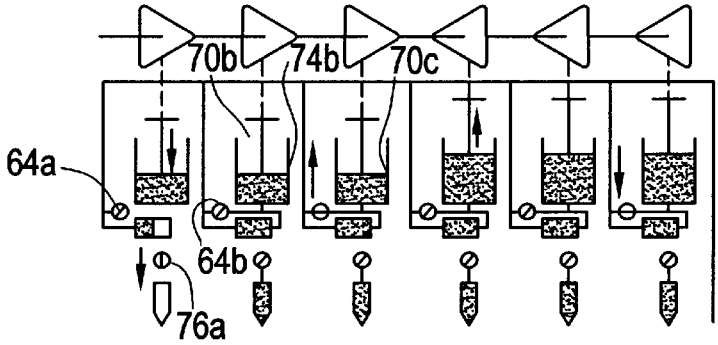
Figure 10F:
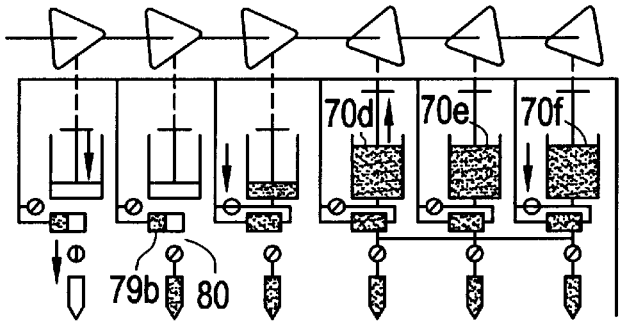
Figure 10G:
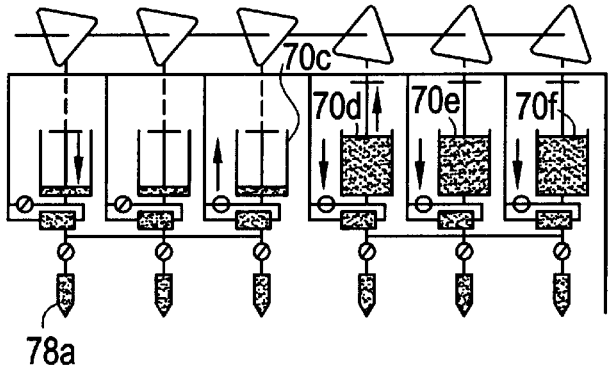

The fuel system 65 operating cycle begins with set 66 unit injectors spilling fuel at low pressure to supply through their respective, open, pressure control valves 64 (FIG. 10*a*). All three shuttle valves 79 are closed preventing communication between the injector pressurizing chambers 74 and the common high-pressure interconnecting line 80. Closing pressure control valve 64*a* of unit injector 70*a* interrupts the spilling process for that unit injector 70*a* and initiates the pressurization of unit injector 70*a* (FIG. 10*b*). Shuttle valve 79*a* opens as pressure within unit injector 70*a* begins to exceed that of the interconnecting line 80. Meanwhile, unit injectors 70*a* and 70*c* continue to spill to supply. Normally closed nozzle control valve 76*a* is opened to initiate a low-pressure pilot injection (FIG. 10*c*). Meanwhile, unit injectors 70*a* and 70*c* continue to spill to supply. Nozzle control valve 76*a* is closed to terminate the low-pressure pilot injection (FIG. 10*d*). The pressure of the fuel in the fuel pressurizing chamber 74 of the unit injector 70*a* and interconnecting line 82 subsequently increase with increasing cam displacement. Meanwhile, unit injectors 70*a* and 70*c* continue to spill to supply. Nozzle control valve 76*a* is opened for a second time to initiate a main injection (FIG. 10*e*). At the same time, pressure control valve 64*b* is closed to initiate the pressurization of fuel in the pressurizing chamber 74*b* of unit injector 70*b*. Meanwhile, unit injector 70*c* continues to spill to supply. Nozzle control valve 76*a* remains open continuing the main injection as the pressure within the pressurizing chamber 74*b* of unit injector 70*a* exceeds the pressure in interconnecting line 80 and opens shuttle valve 79*b* (FIG. 10*f*). The combined pumping capacity of two unit injectors 70*a* and 70*a* increases the rate of pressure rise and the fuel delivery rate through nozzle 78*a*. Meanwhile, unit injector 70*c* continues to spill to supply. Nozzle control valve may now be closed to terminate the main injection through nozzle 78*a* (FIG. 10*g*). The pressure in interconnecting line 80 continues to increase as the pressurizing plungers of unit injectors 70*a* and 70*a* approach a point of maximum volumetric displacement. Meanwhile, unit injector 70*c* continues to spill to supply.

Once the set 66 of unit injectors reach the point of maximum volumetric displacement, the energy storage and delivery phases of their operation are complete and the energy recovery phase can begin. Since set 66 and set 68 operating cycles are perfectly out of phase with each other, the recovery can be observed in the set 68 portions of FIGS. 10*a* through 10*g*.

Figure 11:
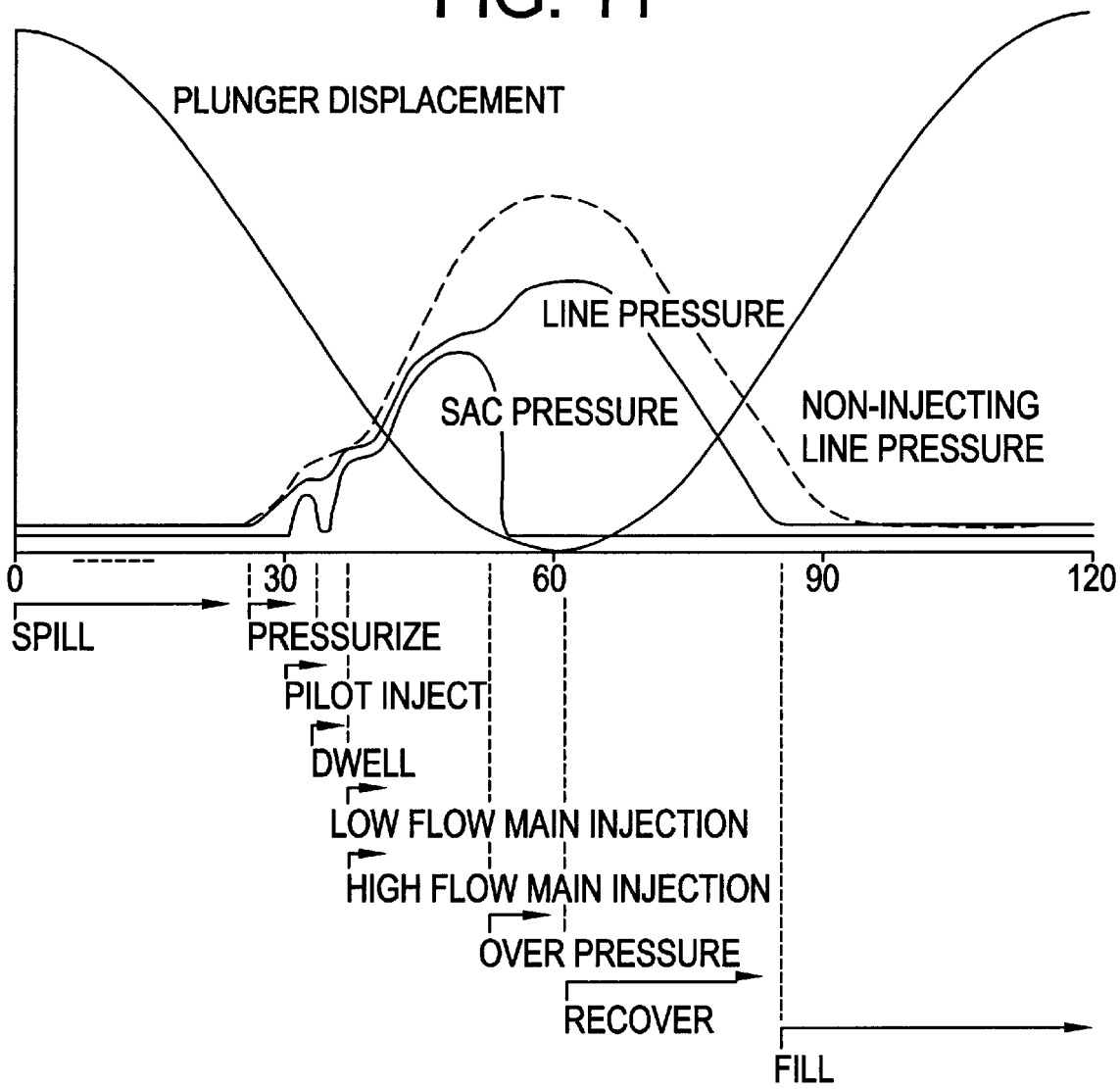
FIG. 11 is a graph of the plunger displacement, line pressure, sac pressure, and non-injecting pressure versus cam angle illustrating 9 different modes of unit injector operation.

Referring again to FIG. 10*a*, the operating cycle continues with the pressurized fuel within set 66. The pressurized fuel within the pressurizing chambers of unit injectors 70*d* and 70*e* and the interconnecting line 82 expands against the pressurizing plungers 72*d* and 72*e*. The camshaft 71 recovers the energy released by this expansion (FIGS. 10*b* through 10*e*). In the mean time fuel is flowing into the expanding pressurizing chamber 74*f* of unit injector 70*f*. Energy recovery from the fuel trapped in unit injectors 70*d* and 70*e* and interconnecting line 82 continues until a pressure balance is achieved with the fuel supply at which time, the fuel supply begins to replace the fuel removed from the system during the operating cycle (FIGS. 10*f* and 10*g*). The filling operation proceeds through corresponding pressure control valves 64*a* and 64*e*. The entire sequence of spilling, pressurizing, pilot injecting, dwelling, low-flow main injecting, high-flow main injecting, over pressurizing, recovering, and filling is illustrated by the hypothetical plunger displacement, common line pressure, and sac pressure responses plotted in FIG. 11.

Figure 12:
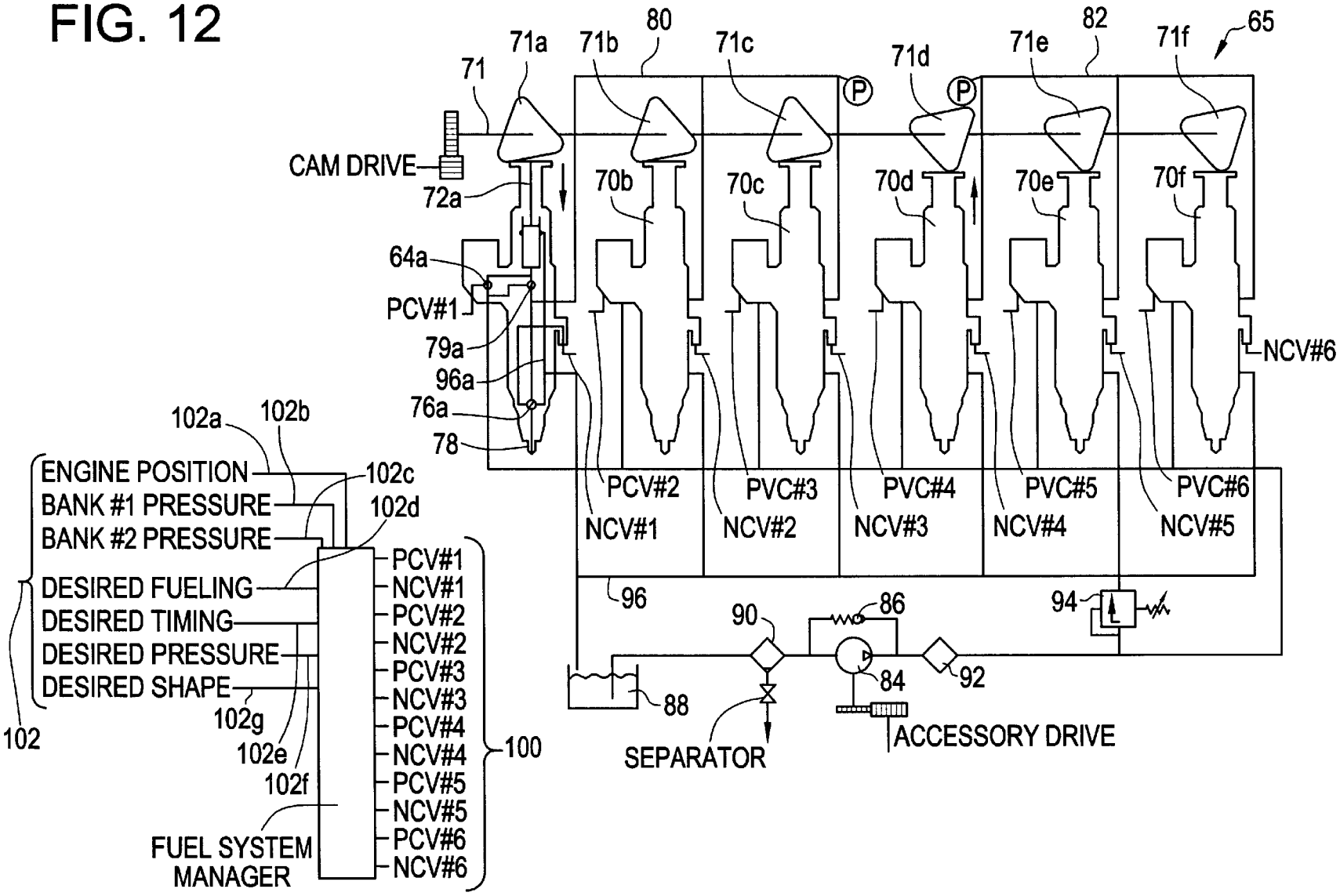
FIG. 12 is a schematic diagram of a fuel system designed in accordance with the second embodiment of the subject invention illustrated in FIGS. 10*a* thru 10*g* including the electronic control unit.

FIG. 12 is a schematic illustration of the fuel system 65 of the second embodiment. Starting at the bottom center and moving counter-clockwise, system 65 is shown as including an engine driven, low pressure, fuel pump 84 with safety relief valve 86. Fuel pump 84 draws fuel from a tank 88 through a combination filter and water separator 90. The discharged fuel is filtered in filter 92 and subsequently pressure regulated by regulator 94 before being supplied to unit injectors 70*a* through 70*f* pressure control valves 64*a* through 64*f*, respectively. A camshaft 71 fitted with three-lobe cams 71*a* through 71*f* is driven at one half engine crank speed to mechanically actuate unit injectors 70*a* through 70*f*. Each unit injector includes a pressurizing plunger 72, pressure control valve 64, shuttle valve 79, nozzle control valve 76, and nozzle 78. The rotational position of the cam relative to the engine crank shaft can be adjusted for optimal phasing of pressurization to the injection window by means not illustrated. Finally, each unit injector is provided with a low-pressure return line 96 to tank 88. In order to achieve the desired benefits of the second embodiment 65, an electronic control unit 98 is provided for generating 12 separate output control signals 100 including one pressure control valve signal and one nozzle control valve signal for each of the six injectors. These control signals will depend on input signals 102 including engine position 102*a*, pressure signal 102*b* for interconnecting line 80, pressure signal 102*c* for interconnecting line 82, desired fueling 102*d*, desired timing 102*e*, desired pressure 102*f* and desired shape 102*g*. The later four signals 102*c* through 102*f* are generated by a combustion control module (not illustrated). The significant advantage of this second embodiment is that the various operational periods of each injector may be controlled independently and/or in concert to achieve desired flow rates, quantities and timing of each injection event.

For example, the pressure control signals and the nozzle control signals generated for the unit injectors of the first and second sets can be arranged to cause the following independent sequential periods of operation for each unit injector of the first and second set of unit injectors:

- a spilling period when the nozzle control valve is in a closed condition, the pressure control valve is in an open condition and the pressurizing plunger is advancing,
- a pressurizing period when the nozzle control valve and the pressure control valve are both in closed conditions and the pressurizing plunger is advancing,
- a pilot injecting period when the nozzle control valve is in an open condition and the pressure control valve is in a closed condition, and the pressurizing plunger is continuing to advance,
- a dwelling period when both the nozzle control valve and the pressure control valve are in a closed condition and the pressurizing plunger is continuing to advance,
- a low-flow main injecting period when the nozzle control valve is in an open condition and the pressure control valve is in a closed condition and the pressurizing plunger is continuing to advance,
- a high-flow main injecting period when the nozzle control valve is in an open condition and the pressure control valve is in a closed condition and the pressurizing plunger is continuing to advance,
- an over pressurizing period when both the nozzle control valve and the pressure control valve are in a closed condition and the pressurizing plunger is continuing to advance,
- a recovering period when the nozzle control valve is closed and the pressure control valve is closed and the pressurizing plunger is retracting, and
- a filling period when the nozzle control valve is closed and the pressure control valve is open and the pressurizing plunger is retracting.

The high-flow main injection period of step f may be caused by more than one nozzle control valves associated with the unit injectors in a given set being open at the same time.

Figure 13:
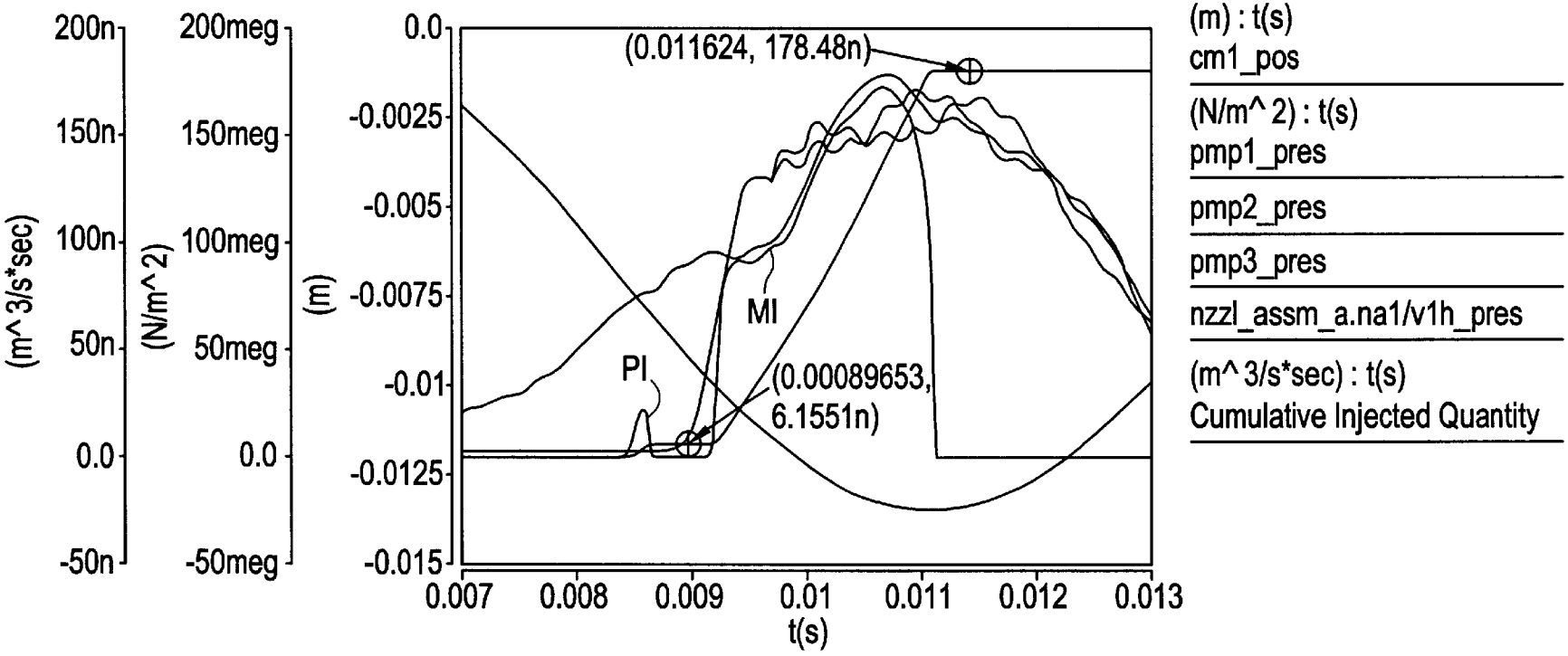
FIG. 13 is a graph simulating the possibility of combining a small quantity pilot injection with a subsequent "boot" shaped main injection.

FIG. 13 contains the results of a hydro-mechanical simulation demonstrating the possibility of combining a small fuel quantity detached pilot injection PI with a so called boot shaped main injection MI.

Shuttle valve 79 has some of the characteristics of a check valve but a conventional non-return (or check) valve alone is inadequate because once the valve opens, it must remain open throughout both energy storage and recovery phases of operation. A conventional non-return valve lacks a latching feature to prevent premature closing at the conclusion of the energy storage phase of operation when the pressure drop across the valve changes sign. The required functionality can be provided with an electro-magnetically, or otherwise actively, operated valve. However, a passively (i.e., pressure or flow) operated valve such as illustrated in FIGS. 14 and 15 would be a less costly, more reliable and more energy efficient solution.

The present invention addresses the need for a passive valve with dual functionality to facilitate the implementation of cyclic energy storage and recovery principles with multiple, independently controlled, pumping elements. The invention is a pressure activated, latching, hydraulic valve with externally reference reset pressure.

Figure 14:
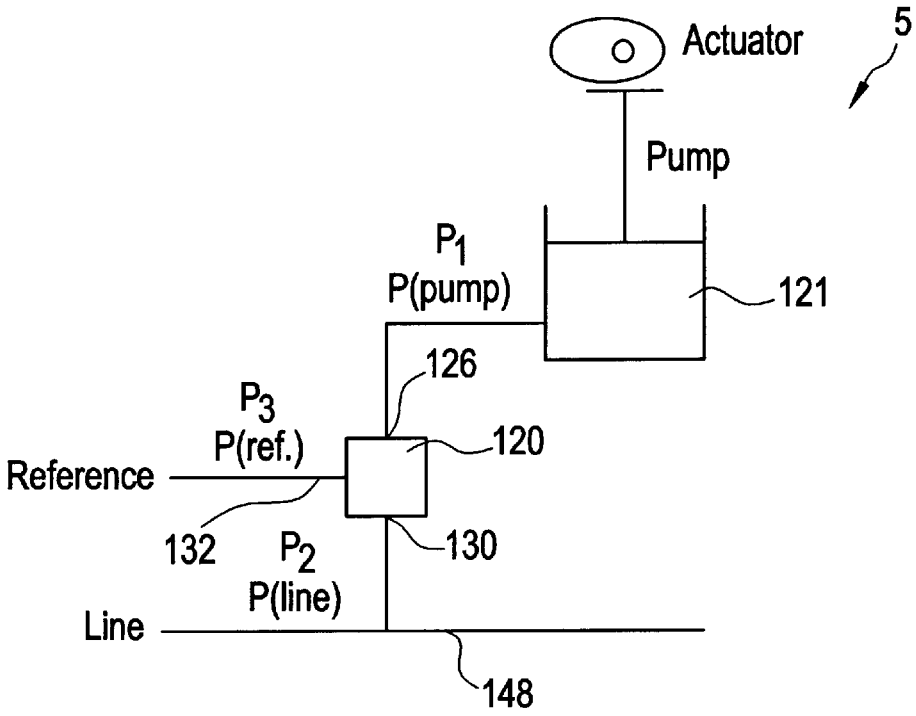
FIG. 14 is a schematic diagram of a pressure activated, hatching valve for use in a system designed in accordance with the subject invention.

FIG. 14 shows one element of a multiple element hydraulic energy storage and recovery systems. The systems includes a pump 121 which may be actuated mechanically or by another means. The pump 121 is connected to the inlet of a pressure activated latching hydraulic valve 120 and may be reset by an externally generated reference reset pressure. The outlet 130 of the valve 120 is connected to a common line 148 that serves as an energy storage device and conduit to other elements. A third port 132 on the valve is connected to a reference pressure source. Pump, line, and reference pressures are designated $P_1$, $P_2$, and $P_3$, respectively.

Figure 15:
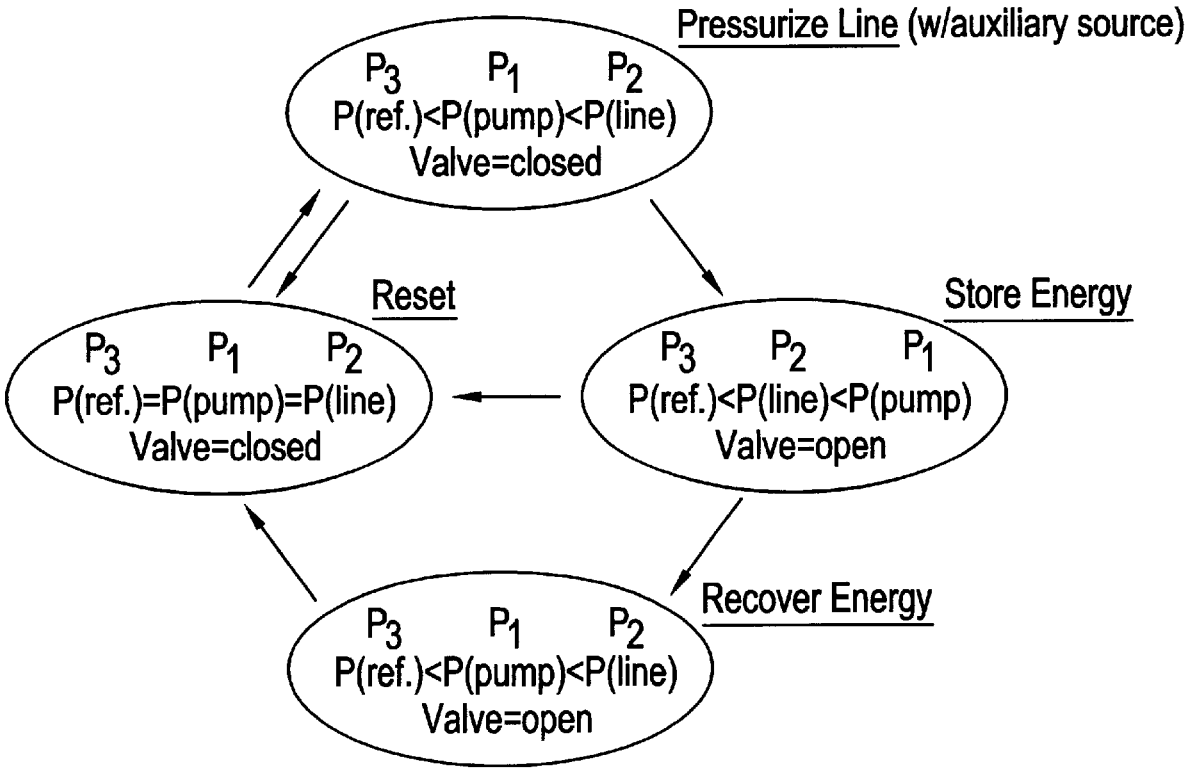
FIG. 15 is a state machine diagram representing the various states in which the valve of FIG. 14 may operate.

A state machine diagram for the energy storage and recovery system illustrated in FIG. 15. FIG. 15 defines four distinct operating states for the valve of FIG. 14 that are characterized by the relative magnitudes of $P_1$, $P_2$ and $P_3$ , and open and closed status of the valve 120. The states are Reset, Pressurize Line, Store Energy and Recover Energy. In the Reset states, $P_1$, $P_2$, and $P_3$ pressures are equalized and the valve isolates port 126 from port 130 (i.e., the valve is closed). The valve 120 continues to isolate the port 126 from the port 130 as line pressure $P_2$ increases relative to pump pressure $P_1$ (i.e., $P_3<P_1<P_2$). In this state, the valve connects the port 126 to port 130 to allow fluid transfer to occur from the port 126 to port 130 with minimal flow loss (i.e., $P_1,=P_2$). From this state, the valve can return to the previously described Reset state or enter a Recover Energy state that allows fluid transfer to occur from port 130 to the port 126. The previously established connection between the pump 121 and line 148 is maintained in this state even though the $P_2$ exceeds $P_1$. Transitions from the Store Energy and Recover Energy states to the Reset state occur when the connection pressure ($P_1$ and $P_2$) drop to a reference pressure $P_3$.

Figure 16:
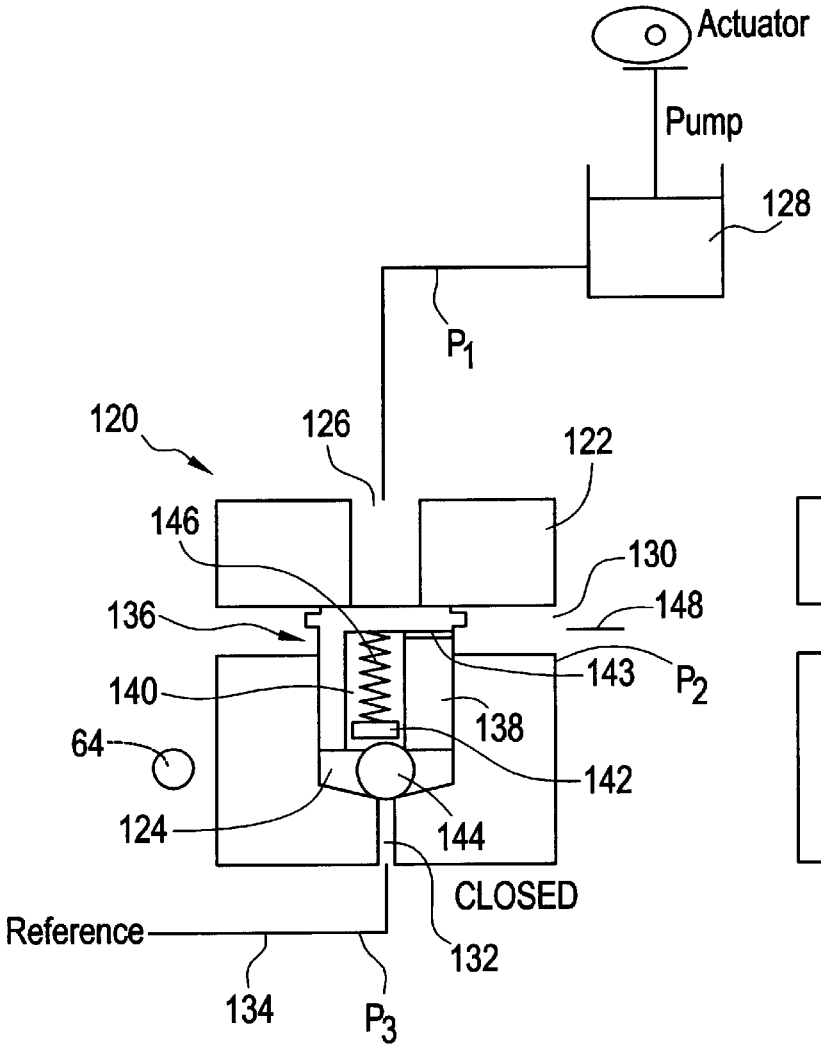
FIG. 16 is a schematic diagram of one embodiment of the valve illustrated in FIG. 14 while the valve is in its closed condition.
Figure 17:
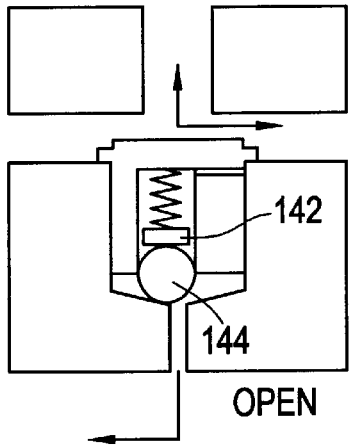
FIG. 17 is a schematic diagram of the valve of FIG. 16 in its open condition.

FIGS. 16 and 17 illustrate a specific embodiment of the pressure activated, latching valve 120 that would be suitable as a shuttle valve 79 as illustrated in FIG. 10*a*–10*g* and FIG. 12. Valve 120 includes a valve body 122 containing a cavity 124. Mounted within cavity 124 is a plunger assembly 136 which may move between a closed position as illustrated in FIG. 16 and an open position as illustrated in FIG. 17. The plunger assembly 136 includes an outer piston 138 mounted to reciprocate within cavity 124 between a first position illustrated in FIG. 16 wherein the flow between ports 126 and 130 is closed off and a second position illustrated in FIG. 17 in which flow between ports 126 and 130 is permitted. Outer piston 138 contains an inner cavity 140 within which is mounted a spring-loaded plunger 142 and ball 144.

FIG. 16 is a hydraulic schematic employing the pressure activated, latching valve 120 illustrated in FIGS. 14 and 15 wherein port 126 at pressure $P_1$ is connected to a pump 128, port 130 at pressure $P_2$ is connected to a line 148 and port 132 is connected via line 134 to a reference supply at pressure $P_3$. FIG. 17 illustrates the valve 120 in its closed position. A spring-loaded inner plunger 142 and ball 144 operate like a conventional non-return (or check valve) to isolate port 126 and port 130 from port 132 when the pressure $P_1$ and $P_2$ in ports 126 and 130 is greater than or equal to pressure $P_3$ in port 134. The valve spring 146 serves the dual function of maintaining the normally closed positions of outer plunger 138 and ball 144. Spring 146 and inner plunger 142 are mounted within a plunger cavity 140 which is offset with respect to ball 144 but is large enough to cause ball 144 to be moved laterally and received within the plunger cavity 140 as the outer plunger moves to its open position.

As illustrated in FIG. 16, ball 144 normally prevents flow to port 132 which is at $P_3$. As pressure $P_1$ begins to exceed pressure $P_2$, forces acting on the outer plunger 138 move it against the spring establishing a connection between port 126 and port 130. A small radial passage 143 permits fuel trapped within the valve cavity to be discharged as the outer plunger 138 begins to toward its open position. As the outer plunger 138 is advanced against its lower stop, the ball 144 is upset allowing fluid behind the outer plunger 138 to escape to port 132. The outer plunger 138 remains latched in this position until the pressure in ports 126 and 130 ($P_1$ and $P_2$) is reduced below the pressure $P_3$ in port 132, the magnitude of the opening pressure.

Figure 18:
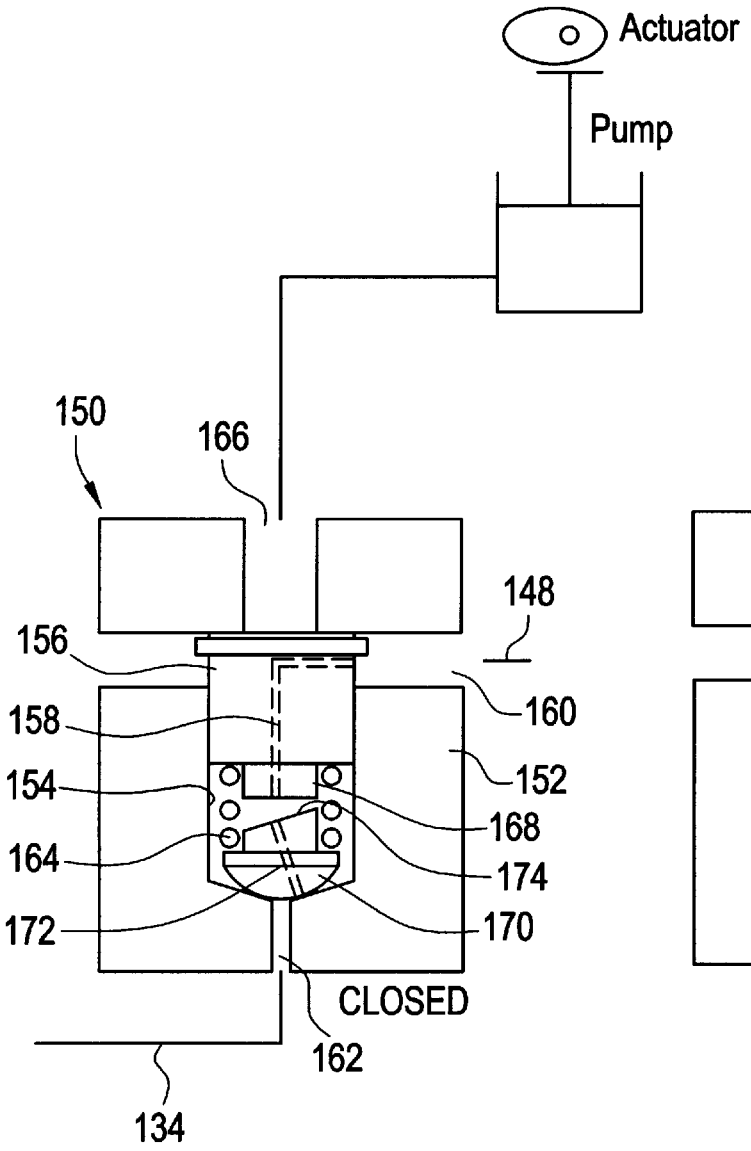
FIG. 18 is a schematic diagram of a second embodiment of the valve illustrated in FIG. 14 while the valve is in its closed condition.
Figure 19:
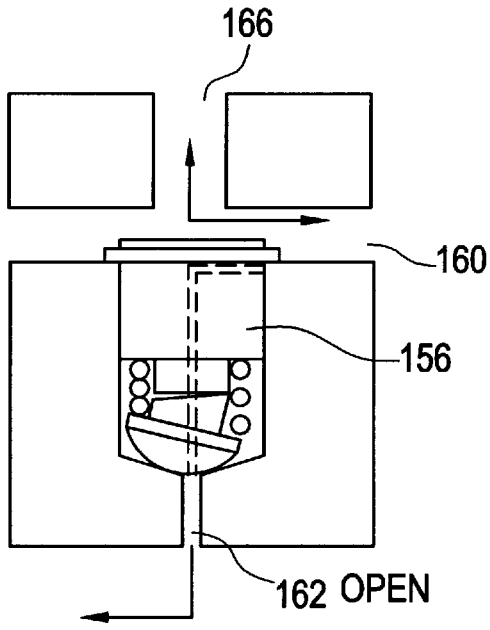
FIG. 19 is a schematic diagram of the valve of FIG. 18 in its open condition.

FIG. 18 and 19 show the second of two embodiments of the valve 120 connected as shown in FIG. 14. FIG. 18 shows a valve 150 in a closed position consistent with the Reset and Pressurize Line states of FIG. 15. Valve 150 includes a valve body 152 which contains a cavity 154 for receiving a plunger 156 arranged to move axially between the closed position illustrated in FIG. 18 and an open position illustrated in FIG. 19. Plunger 156 contains an internal passageway 158 adopted to fluidically connect a line port 160 to cavity 154 as illustrated in FIG. 18. Plunger 156 is biased toward its closed position by spring 164 and remains in its closed position until the pump pressure supplied to port 166 exceeds the pressure supplied to the line port 160 at which point plunger 156 moves towards its open position causing fluid to be expelled from cavity 154 through passage 158 and port 160 into line 148. As the plunger 156 continues to move toward its open position, a projection 168 on the plunger 156 engages a semi-spherical element 170 located within cavity 154. Semi-spherical element 170 contains an angled passage 172 positioned to remain closed when it is in the position illustrated in FIG. 18. However, a projection 174 on the upper end of semi-spherical element 170 has an inclined surface 174 which causes element 170 to be tilted into the position illustrated in FIG. 19 and cause the angled passage 172 to communicate with port 162 connected to a reference pressure supplied by line 134. FIG. 19 shows the valve 150 of FIG. 18 in its open position consistent with the Store Energy and Recover Energy states of FIG. 15. The valve 150 is operationally similar to valve 120 of FIGS. 16 and 17. However, the plunger 156 bears against element 170 to rotate it into completing a fluid connection to a reference pressure or drain. When in this position, plunger will only return from its open to its closed position when the pressure at ports 166 (connected with the pump) and at port 160 connected with line 148 falls below the reference pressure in line 134.

INDUSTRIAL APPLICABILITY

The subject invention will find utility as a fuel system for medium to heavy duty compression ignition engines using diesel fuels with particular utility for use on engines for over-the-road vehicles, construction, marine and other applications requiring highly efficient, reduced emission engine performance. The disclosed invention will find application on other types of engines using other liquid fuels such as gasoline and on engines employing multiple fuels. The disclosed system would also find utility in hydraulic energy transmission devices and systems that can effectively utilize cyclic energy storage and recovery. For example, the invention could be used in systems for hydraulically actuating intake and exhaust valves for internal combustion engines and in hydraulically actuated material fatigue test equipment.

We claim:

1. A fuel injection system for an internal combustion engine having multiple combustion chambers and a camshaft for cyclically imparting pressurization energy to, and recovering pressurization energy from, fuel supplied to the engine, comprising a. a source of fuel at low pressure;

b. a first set of unit injectors mounted for injecting fuel at high pressure into the combustion chambers, respectively, of the internal combustion engine, each said unit injector including i. an injector body containing a bore for receiving fuel at low pressure from said source of fuel and an injection orifice in fluid communication periodically with said bore, and ii. a pressurizing plunger mounted for reciprocation within said bore to form a fuel pressurizing chamber from which fuel may be withdrawn at relatively high pressure for injection into a corresponding combustion chamber of the engine through said injection orifice;

c. a camshaft linkage for simultaneously reciprocating the pressurizing plungers of a set of at least two unit injectors as the engine camshaft rotates to selectively impart pressurization energy to fuel trapped within said fuel pressurizing chambers when said pressurizing plungers advance and to recover pressurization energy from fuel trapped within said fuel pressurizing chambers when said pressurizing plungers retract; and d. a first interconnecting line for allowing fluidic interconnection of the fuel pressurizing chambers formed within said first set of unit injectors to allow fluidic linkage of the volume of fuel being simultaneously pressurized and depressurized within said interconnected fuel pressurizing chambers of said first set of unit injectors, wherein the total volume of fuel that is fluidically linked together within said first set of synchronized unit injectors substantially exceeds the volume of fuel injected during each injection event to avoid substantial loss of injection pressure during each injection event, and wherein each said unit injector of said first set includes a nozzle control valve having a closed condition for preventing the flow of fuel into the corresponding combustion chamber and an open condition in which fuel from said fluidically connected fuel pressurizing chambers of said first set of unit injectors is allowed to flow into the corresponding combustion chamber through the corresponding injection orifice.

2. A fuel injection system for an internal combustion engine having multiple combustion chambers and a camshaft for cyclically imparting pressurization energy to, and recovering pressurization energy from, fuel supplied to the engine, comprising a. a source of fuel at low pressure;

b. a first set of unit injectors mounted for injecting fuel at high pressure into the combustion chambers, respectively, of the internal combustion engine, each said unit injector including i. an injector body containing a bore for receiving fuel at low pressure from said source of fuel and an injection orifice in fluid communication periodically with said bore, and ii. a pressurizing plunger mounted for reciprocation within said bore to form a fuel pressurizing chamber from which fuel may be withdrawn at relatively high pressure for injection into a corresponding combustion chamber of the engine through said injection orifice;

c. a camshaft linkage for simultaneously reciprocating the pressurizing plungers of a set of at least two unit injectors as the engine camshaft rotates to selectively impart pressurization energy to fuel trapped within said fuel pressurizing chambers when said pressurizing plungers advance and to recover pressurization energy from fuel trapped within said fuel pressurizing chambers when said pressurizing plungers retract; and d. a first interconnecting line for allowing fluidic interconnection of the fuel pressurizing chambers formed within said first set of unit injectors to allow fluidic linkage of the volume of fuel being simultaneously pressurized and depressurized within said interconnected fuel pressurizing chambers of said first set of unit injectors, (i) wherein the total volume of fuel that is fluidically linked together within said first set of synchronized unit injectors substantially exceeds the volume of fuel injected during each injection event to avoid substantial loss of injection pressure during each injection event, (ii) wherein said camshaft linkage is arranged for reciprocating synchronously the pressurizing plungers of a second set of at least two unit injectors as the engine camshaft rotates to selectively impart pressurization energy to fuel trapped within the corresponding fuel pressurizing chambers of said second set of unit injectors when the pressurizing plungers of said second set of unit injectors advance and to recover pressurization energy from fuel trapped within said fuel pressurizing chambers when said pressurizing plungers retract, and further including a second interconnecting line for allowing fluidic interconnection of the fuel pressurizing chambers of said second set of synchronized unit injectors to allow fluidic linkage of the volume of fuel being simultaneously pressurized and depressurized within said interconnected fuel pressurizing chambers of said second set of unit injectors, said second set of synchronized unit injectors being out of phase by a predetermined amount with respect to said first set, wherein the total volume of fuel that is fluidically linked together within said second set of synchronized unit injectors substantially exceeds the volume of fuel injected during each injection event to avoid substantial loss of injection pressure during each injection event, and (iii) wherein each said unit injector of said second set of unit injectors includes a nozzle control valve having a closed position for preventing the flow of fuel into the corresponding combustion chamber and an open position in which fuel from said fluidically connected fuel pressurizing chambers of said first set of unit injectors is allowed to flow into the corresponding combustion chamber through the corresponding injection orifice.

3. A fuel injection system as defined in claim 2, wherein each said nozzle control valve includes an nozzle control valve actuator responsive to an electrical nozzle control valve signal to cause the corresponding nozzle control valve to change between its closed condition and its open condition, and wherein each unit injector includes a pressure control valve, each said pressure control valve includes a pressure control valve actuator responsive to an electrical pressure control valve signal to cause the corresponding pressure control valve to change between its open condition and its closed condition and further including a electronic control unit electrically connected to said nozzle control valve actuators and said pressure control valve actuators for generating said electrical nozzle control valve signals and for generating said pressure control valve signals at selected times and for selected durations to control the pressure, timing, rate and quantity of fuel injection during each fuel injection event.

4. A fuel injection system as defined in claim 3, wherein said electronic control unit includes input ports for receiving signals representative of engine operation.

5. A fuel injection system as defined in claim 4, wherein said engine operation signals include at least one or more signals representative of engine position, pressure of fuel in said first and second interconnecting lines, desired fueling, desired timing, desired pressure and desired rate.

6. A fuel injection system as defined in claim 5, wherein said pressure control signals and said nozzle control signals are generated to cause one of said pressure control valve to close to cause the pressure of fuel within said first interconnecting line to reach a pilot injection pressure appropriate for pilot injection through one of said unit injectors at which time the corresponding nozzle control valve of said unit injector is opened for an interval to allow a pilot injection from said unit injector after which the said control nozzle valve is closed to allow the pressure of fuel to increase to a main injection pressure higher than said pilot injection pressure at which time said nozzle control valve is again opened for an interval to allow a main injection from said unit injector.

7. A fuel injection system as defined in claim 6, wherein said pressure control signals and said nozzle control signals are generated by said electronic control unit in a manner to control the timing, rate, quantity and pressure of a separate pilot and main injection from each unit injector within said first and second sets to cause the engine to achieve the desired fueling, timing, pressure and shape indicated by the operating signals received by said electronic control unit.

8. A fuel injection system as defined in claim 7, wherein said pressure control signals and said nozzle control signals generated for the unit injectors of either of said first or second sets cause the following sequential periods of operation for all unit injectors within that set of unit injectors:

a. a spilling period when said nozzle control valves are in a closed condition, and said pressure control valve is in an open condition and said pressurizing plungers of the set are advancing, b. a pressurizing period when said nozzle control valves and said pressure control valve are in closed conditions and said pressurizing plungers of the set are advancing, c. an injecting period when one nozzle control valve is selectively placed in an open condition while all other nozzle control and pressure control valves remain in closed conditions and while the pressurizing plungers of the set are continuing to advance d. an over pressurizing period when said nozzle control valves and said pressure control valve are in a closed condition and said pressurizing plungers of the set are continuing to advance, e. a recovering period when said nozzle control valves and said pressure control valve are in a closed condition and said pressurizing plunger of the set are retracting, and f. a filling period when said nozzle control valve is closed and said pressure control valve is open and said pressurizing plunger is retracting, wherein said pressure control signals and said nozzle control signals generated for the unit injectors of either of said first or second sets cause the following sequential periods of operation for each unit injector independent of the periods of operation of the other unit injectors within that set of unit injectors:

a. a pilot injecting period when said nozzle control valve of a unit injector in one set is in an open condition and said pressure control valve for that set is in a closed condition, and said pressurizing plunger for that unit injector is advancing, b. a dwelling period when both said nozzle control valve of an injector in one set and said pressure control valve for that set are in a closed condition and said pressurizing plunger for that unit injector is continuing to advance, c. a low-flow main injecting period when said nozzle control valve of a unit injector in one set is in an open condition and said pressure control valve for that set is in a closed condition and said pressurizing plunger for that unit injector is continuing to advance, and d. a high-flow main injecting period when said nozzle control valve of a unit injector in one set is in an open condition and said pressure control valve for that set is in a closed condition and said pressurizing plunger for that unit injector is continuing to advance.

9. A fuel injection system for an internal combustion engine having multiple combustion chambers and a camshaft for cyclically imparting pressurization energy to, and recovering pressurization energy from, fuel supplied to the engine, comprising a. a source of fuel at low pressure;

b. a first set of unit injectors mounted for injecting fuel at high pressure into the combustion chambers, respectively, of the internal combustion engine, each said unit injector including i. an injector body containing a bore for receiving fuel at low pressure from said source of fuel and an injection orifice in fluid communication periodically with said bore, and ii. a pressurizing plunger mounted for reciprocation within said bore to form a fuel pressurizing chamber from which fuel may be withdrawn at relatively high pressure for injection into a corresponding combustion chamber of the engine through said injection orifice;

c. a camshaft linkage for simultaneously reciprocating the pressurizing plungers of a set of at least two unit injectors as the engine camshaft rotates to selectively impart pressurization energy to fuel trapped within said fuel pressurizing chambers when said pressurizing plungers advance and to recover pressurization energy from fuel trapped within said fuel pressurizing chambers when said pressurizing plungers retract; and d. a first interconnecting line for allowing fluidic interconnection of the fuel pressurizing chambers formed within said first set of unit injectors to allow fluidic linkage of the volume of fuel being simultaneously pressurized and depressurized within said interconnected fuel pressurizing chambers of said first set of unit injectors, wherein the total volume of fuel that is fluidically linked together within said first set of synchronized unit injectors substantially exceeds the volume of fuel injected during each injection event to avoid substantial loss of injection pressure during each injection event, wherein each said unit injector includes a pressure control valve connected to said source of fuel, each said pressure control valve having an open condition in which fuel is allowed to flow in either direction between said source of fuel and the corresponding fuel pressurizing chamber of said unit injector and a closed condition in which no fuel is allowed to flow between the corresponding fuel pressurizing chamber and said source of fuel.

10. A fuel injection system as defined in claim 9, wherein each said unit injector in said first set of unit injectors includes a nozzle control valve having a closed condition for preventing the flow of fuel into the corresponding combustion chamber and an open condition in which fuel from said first interconnecting line is allowed to flow into the corresponding combustion chamber through the corresponding injection orifice.

11. A fuel injection system as defined in claim 10, wherein each said unit injector within said first set of unit injectors further includes a shuttle valve having a closed condition in which fuel is prevented from flowing from the corresponding fuel pressurizing chamber into said first interconnecting line whenever the pressure within the corresponding fuel pressurizing chamber is less than the pressure within said first interconnecting line and an open condition in which fuel is allowed to flow from said fuel pressurizing chamber into said first interconnecting line wherever the pressure within said fuel pressurizing chamber is greater than the pressure within said first interconnecting line.

12. A fuel injection system as defined in claim 9, wherein said camshaft linkage is arranged for causing the pressurizing plungers of a second set of at least two unit injectors to reciprocate synchronously as the engine camshaft rotates to impart selectively pressurization energy to fuel trapped within the corresponding fuel pressurizing chambers of said second set of unit injectors when the pressurizing plungers of said second set of unit injectors advance and to recover pressurization energy from fuel trapped within said fuel pressurizing chambers when said pressurizing plungers retract, and further including a second interconnecting line for allowing fluidic interconnection of the fuel pressurizing chambers of said second set of synchronized unit injectors to allow fluidic linkage of the volume of fuel being simultaneously pressurized and depressurized within said interconnected fuel pressurizing chambers of said second set of unit injectors, said second set of synchronized unit injectors being out of phase by a predetermined amount with respect to said first set, wherein the total volume of fuel that is fluidically linked together within said second set of synchronized unit injectors substantially exceeds the volume of fuel injected during each injection event to avoid substantial loss of injection pressure through out each injection event.

13. A fuel injection system as defined in claim 12, wherein each said unit injector in said second set of unit injectors includes a nozzle control valve having a closed condition for preventing the flow of fuel into the corresponding combustion chamber and an open condition in which fuel from said second interconnecting line is allowed to flow into the corresponding combustion chamber through the corresponding injection orifice.

14. A fuel injection system as defined in claim 13, wherein each said unit injector within said second set of unit injectors further includes a shuttle valve having a closed condition to prevent fuel from flowing from said fuel pressurizing chamber into said second interconnecting line whenever the pressure within said fuel pressurizing chamber is less than the pressure within said second interconnecting line and an open condition to allow fuel to flow from said fuel pressurizing chamber into said second interconnecting line wherever the pressure with said fuel pressurizing chamber is greater than the pressure within said second interconnecting line.

15. A fuel injection system as defined in claim 14, wherein each said nozzle control valve includes a nozzle control valve actuator responsive to an electrical nozzle control valve signal to cause the corresponding nozzle control valve to change between its closed condition and its open condition, and wherein each said pressure control valve includes a pressure control valve actuator responsive to an electrical pressure control valve signal to cause the corresponding pressure control valve to change between its open condition and its closed condition and further including a electronic control unit electrically connected to said nozzle control valve actuators and said pressure control valve actuators for generating said electrical nozzle control valve signals and for generating said pressure control valve signals at selected times and for selected durations to control the pressure, timing, rate and quantity of fuel injection during each fuel injection event.

16. A fuel injection system as defined in claim 15, wherein said electronic control unit includes input ports for receiving signals representative of engine operation.

17. A fuel injection system as defined in claim 16, wherein said engine operation signals include at least one or more signals representative of engine position, pressure of fuel in said first and second interconnecting lines, desired fueling, desired timing, desired pressure and desired rate.

18. A fuel injection system as defined in claim 17, wherein said pressure control signals and said nozzle control signals are generated to cause the pressure control valves of said first set of unit injectors to close at selected times to cause the pressure of fuel within said first interconnecting line to reach a pilot injection pressure appropriate for pilot injection through one of said unit injectors at which time the corresponding nozzle control valve of said unit injector is opened for an interval to allow a pilot injection from said unit injector after which said control nozzle valve is closed to allow the pressure of fuel to increase to a main injection pressure higher than said pilot injection pressure at which time said nozzle control valve is again opened for an interval to allow a main injection from said unit injector.

19. A fuel injection system as defined in claim 18, wherein said pressure control signals and said nozzle control signals are generated by said electronic control unit in a manner to control the timing, rate, quantity and pressure of a separate pilot and main injection from each unit injector within said first and second sets to cause the engine to achieve the desired fueling, timing, pressure and shape indicated by the operating signals received by said electronic control unit.

20. A fuel injection system as defined in claim 19, wherein said pressure control signals and said nozzle control signals generated for the unit injectors of said first and second sets cause the following independent sequential periods of operation for each unit injector of said first and second set of unit injectors:

a. a spilling period when said nozzle control valve is in a closed condition, said pressure control valve is in an open condition and said pressurizing plunger is advancing, b. a pressurizing period when said nozzle control valve and said pressure control valve are both in closed conditions and said pressurizing plunger is advancing, c. a pilot injecting period when said nozzle control valve is in an open condition and said pressure control valve is in a closed condition, and said pressurizing plunger is continuing to advance, d. a dwelling period when both said nozzle control valve and said pressure control valve are in a closed condition and said pressurizing plunger is continuing to advance, e. a low-flow main injecting period when said nozzle control valve is in an open condition and said pressure control valve is in a closed condition and said pressurizing plunger is continuing to advance, f. a high-flow main injecting period when said nozzle control valve is in an open condition and said pressure control valve is in a closed condition and said pressurizing plunger is continuing to advance, g. an over pressurizing period when both said nozzle control valve and said pressure control valve are in a closed condition and said pressurizing plunger is continuing to advance, h. a recovering period when said nozzle control valve is closed and said pressure control valve is closed and said pressurizing plunger is retracting, and i. a filling period when said nozzle control valve is closed and said pressure control valve is open and said pressurizing plunger is retracting.

21. A fuel injection system as defined in claim 20, wherein the pressure control signals and said nozzle control signals generated by said electronic control unit may cause one or more unit injectors within either set to be in the pressurization, pilot injecting, dwelling, low-flow main, high flow main or over pressure periods while one or more other unit injectors of the same set are in the spill period as the pressurization plungers of that set are being advanced.

22. A fuel injection system as defined in claim 21, wherein the pressure control signals and said nozzle control signals generated by said electronic control unit may cause one or more unit injectors within either set to be in the fill period while one or more other unit injectors of the same set are in the recovery period as the pressurization plungers of that set are being retracted.

23. A fuel injection system as defined in claim 11, wherein each said shuttle valve operates in response to the relative magnitude of three separate fluid pressures including $P_p$ which in the pressure of fuel within the corresponding fuel pressurizing chamber $P_l$ which is the pressure of fuel in the interconnecting line to which the corresponding unit injector is connected and $P_m$ which is a reference pressure supplied from a source of reference pressure and further wherein said valve may operate in one of four states, including:

a. a line pressurization state in which $P_m<P_p<P_l$ when said shuttle valve is closed, b. a reset state in which $P_r=P_p=P_l$ and said shuttle valve is closed, c. a energy storage state in which $P_m<P_l<P_p$ and said shuttle valve is open, and d. a energy recovery state in which $P_m<P_p<P_l$.

24. A fuel injection system as defined in claim 23, wherein said shuttle valve includes:

a. a valve body containing a valve cavity fluidically connected with said fuel pressurizing chamber, said interconnecting line and said source of reference pressure, b. an outer plunger reciprocally mounted within said valve cavity moveable between a closed condition in which fuel is not allowed to flow between said pressurization chamber and said interconnecting line and an open condition in which fluid is allowed to flow between said pressurization chamber and said interconnecting line, c. an inner plunger mounted within said outer plunger, d. a ball mounted to normally close fuel communication between said valve cavity and said source reference pressure, and e. a spring for biasing said inner plunger into contact with said ball and for biasing said outer plunger toward its closed position, wherein said outer plunger contains a plunger cavity which is offset with respect to said ball to cause said ball to be moved laterally as said outer plunger moves toward its open position.

25. A fuel injection system as defined in claim 23, wherein said shuttle valve includes:

a. a valve body containing a valve cavity fluidically connected with said fuel pressurizing chamber, said interconnecting line and said source of reference pressure, b. a plunger reciprocally mounted within said valve cavity movable between a closed condition in which fuel is not allowed to flow between said pressurizing chamber and said interconnecting line and an open condition in which fluid is allowed to flow between said pressurization chamber and said interconnecting line, and c. a semi-spherical valve element containing an angled passage for normally residing in a closed position blocking communication between said valve cavity and said source of reference pressure, but moveable to an open position in which said angled passage is realigned to cause fluid communication between said valve cavity and said source of reference pressure, wherein said plunger and said spherical valve element have contact surfaces shaped to cause said semi-spherical valve to move to its open position when said plunger moves toward its open position.

26. A fuel injection system for an internal combustion engine having multiple combustion chambers, comprising a. a source of fuel at low pressure;

b. a first set of injectors mounted for injecting fuel at high pressure into the combustion chambers, respectively, of the internal combustion engine, each said injector including i. an injector body containing a bore for receiving fuel at low pressure from said source of fuel and an injection orifice in fluid communication periodically with said bore, and ii. a pressurizing plunger mounted for reciprocation within said bore to form a fuel pressurizing chamber from which fuel may be withdrawn at relatively high pressure for injection into a corresponding combustion chamber of the engine through said injection orifice;

c. actuating means for simultaneously reciprocating the pressurizing plungers of a set of at least two injectors to selectively impart pressurization energy to fuel trapped within said fuel pressurizing chambers when said pressurizing plungers advance and to recover pressurization energy from fuel trapped within said fuel pressurizing chambers when said pressurizing plungers retract; and d. a first interconnecting means for allowing fluidic interconnection of the fuel pressurizing chambers formed within said first set of injectors to allow fluidic linkage of the volume of fuel being simultaneously pressurized and depressurized within said interconnected fuel pressurizing chambers of said first set of injectors, wherein the total volume of fuel that is fluidically linked together within said first set of synchronized injectors substantially exceeds the volume of fuel injected during each injection event to avoid substantial loss of injection pressure during each injection event, wherein said camshaft linkage is arranged for reciprocating synchronously the pressurizing plungers of a second set of at least two injectors as the engine camshaft rotates to impart selectively pressurization energy to fuel trapped within the corresponding fuel pressurizing chambers of said second set of injectors when the pressurizing plungers of said second set of injectors advance and to recover pressurization energy from fuel trapped within said fuel pressurizing chambers when said pressurizing plungers retract, and further including a second interconnecting means for allowing fluidic interconnection of the fuel pressurizing chambers of said second set of synchronized injectors to allow fluidic linkage of the volume of fuel being simultaneously pressurized and depressurized within said interconnected fuel pressurizing chambers of said second set of injectors, said second set of synchronized injectors being out of phase by a predetermined amount with respect to said first set, wherein the total volume of fuel that is fluidically linked together within said second set of synchronized injectors substantially exceeds the volume of fuel injected during each injection event to avoid substantial loss of injection pressure during each injection event, and wherein each said injector of said second set of injectors includes a nozzle control valve having a closed position for preventing the flow of fuel into the corresponding combustion chamber and an open position in which fuel from said fluidically connected fuel pressurizing chambers of said first set of injectors is allowed to flow into the corresponding combustion chamber through the corresponding injection orifice.

27. A fuel injection system as defined in claim 26, wherein each said nozzle control valve includes a nozzle control valve actuator responsive to an electrical nozzle control valve signal to cause the corresponding nozzle control valve to change between its closed condition and its open condition, and further including at least one pressure control valve associated with each said interconnecting means, wherein each said pressure control valve includes a pressure control valve actuator responsive to an electrical pressure control valve signal to cause the corresponding pressure control valve to change between its open condition and its closed condition and further including a electronic control electrically connected to said nozzle control valve actuators and said pressure control valve actuators for generating said electrical nozzle control valve signals and for generating said pressure control valve signals at selected times and for selected durations to control the pressure, timing, rate and quantity of fuel injection during each fuel injection event.

28. A fuel injection system as defined in claim 27, wherein said electronic control includes input ports for receiving signals representative of engine operation.

29. A fuel injection system as defined in claim 28, wherein said engine operation signals include at least one or more signals representative of engine position, pressure of fuel in said first and second interconnecting means, desired fueling, desired timing, desired pressure and desired rate.

30. A fuel injection system as defined in claim 29, wherein said pressure control signals and said nozzle control signals are generated to cause one of said pressure control valves to close to cause the pressure of fuel within said first interconnecting means to reach a pilot injection pressure appropriate for pilot injection through one of said injectors at which time the corresponding nozzle control valve of said injector is opened for an interval to allow a pilot injection from said injector after which the said control nozzle valve is closed to allow the pressure of fuel to increase to a main injection pressure higher than said pilot injection pressure at which time said nozzle control valve is again opened for an interval to allow a main injection from said injector.

31. A fuel injection system as defined in claim 30, wherein said pressure control signals and said nozzle control signals are generated by said electronic control in a manner to control the timing, rate, quantity and pressure of a separate pilot and main injection from each injector within said first and second sets to cause the engine to achieve the desired fueling, timing, pressure and shape indicated by the operating signals received by said electronic control.

32. A fuel injection system as defined in claim 31, wherein said pressure control signals and said nozzle control signals generated for the injectors of either of said first or second sets cause the following sequential periods of operation for all injectors within that set of injectors:

a. a spilling period when said nozzle control valves are in a closed condition, and said pressure control valve is in an open condition and said pressurizing plungers of the set are advancing, b. a pressurizing period when said nozzle control valves and said pressure control valve are in closed conditions and said pressurizing plungers of the set are advancing, c. an injecting period when one nozzle control valve is selectively placed in an open condition while all other nozzle control and pressure control valves remain in closed conditions and while the pressurizing plungers of the set are continuing to advance d. an over pressurizing period when said nozzle control valves and said pressure control valve are in a closed condition and said pressurizing plungers of the set are continuing to advance, e. a recovering period when said nozzle control valves and said pressure control valve are in a closed condition and said pressurizing plunger of the set are retracting, and f. a filling period when said nozzle control valve is closed and said pressure control valve is open and said pressurizing plunger is retracting.

33. A fuel injection system as defined in claim 32, wherein said pressure control signals and said nozzle control signals generated for the injectors of either of said first or second sets cause the following sequential periods of operation for each injector independent of the periods of operation of the other injectors within that set of injectors:

a. a pilot injecting period when said nozzle control valve of a injector in one set is in an open condition and said pressure control valve for that set is in a closed condition, and said pressurizing plunger for that injector is advancing, b. a dwelling period when both said nozzle control valve of an injector in one set and said pressure control valve for that set are in a closed condition and said pressurizing plunger for that injector is continuing to advance, c. a low-flow main injecting period when said nozzle control valve of a injector in one set is in an open condition and said pressure control valve for that set is in a closed condition and said pressurizing plunger for that injector is continuing to advance, and d. a high-flow main injecting period when said nozzle control valve of a injector in one set is in an open condition and said pressure control valve for that set is in a closed condition and said pressurizing plunger for that injector is continuing to advance.

34. A fuel injection system for an internal combustion engine having multiple combustion chambers, comprising a. a source of fuel at low pressure;

b. a first set of injectors mounted for injecting fuel at high pressure into the combustion chambers, respectively, of the internal combustion engine, each said injector including i. an injector body containing a bore for receiving fuel at low pressure from said source of fuel and an injection orifice in fluid communication periodically with said bore, and ii. a pressurizing plunger mounted for reciprocation within said bore to form a fuel pressurizing chamber from which fuel may be withdrawn at relatively high pressure for injection into a corresponding combustion chamber of the engine through said injection orifice;

c. actuating means for simultaneously reciprocating the pressurizing plungers of a set of at least two injectors to selectively impart pressurization energy to fuel trapped within said fuel pressurizing chambers when said pressurizing plungers advance and to recover pressurization energy from fuel trapped within said fuel pressurizing chambers when said pressurizing plungers retract; and d. a first interconnecting means for allowing fluidic interconnection of the fuel pressurizing chambers formed within said first set of injectors to allow fluidic linkage of the volume of fuel being simultaneously pressurized and depressurized within said interconnected fuel pressurizing chambers of said first set of injectors, wherein the total volume of fuel that is fluidically linked together within said first set of synchronized injectors substantially exceeds the volume of fuel injected during each injection event to avoid substantial loss of injection pressure during each injection event, wherein each said injector of said first set includes a nozzle control valve having a closed condition for preventing the flow of fuel into the corresponding combustion chamber and an open condition in which fuel from said fluidically connected fuel pressurizing chambers of said first set of injectors is allowed to flow into the corresponding combustion chamber through the corresponding injection orifice.

35. A fuel injection system as defined in claim 34, wherein each said injector includes a pressure control valve connected to said source of fuel, each said pressure control valve having an open condition in which fuel is allowed to flow in either direction between said source of fuel and the corresponding fuel pressurizing chamber of said injector and a closed condition in which no fuel is allowed to flow between the corresponding fuel pressurizing chamber and said source of fuel.

36. A fuel injection system as defined in claim 35, wherein each said injector in said first set of injectors includes a nozzle control valve having a closed condition for preventing the flow of fuel into the corresponding combustion chamber and an open condition in which fuel from said first interconnecting means is allowed to flow into the corresponding combustion chamber through the corresponding injection orifice.

37. A fuel injection system as defined in claim 36, wherein each said injector within said first set of injectors further includes a shuttle valve having a closed condition in which fuel is prevented from flowing from the corresponding fuel pressurizing chamber into said first interconnecting means whenever the pressure within the corresponding fuel pressurizing chamber is less than the pressure within said first interconnecting means and an open condition in which fuel is allowed to flow from said fuel pressurizing chamber into said first interconnecting means wherever the pressure with said fuel pressurizing chamber is greater than the pressure within said first interconnecting means.

38. A fuel injection system as defined in claim 35, wherein said actuating means is arranged for causing the pressurizing plungers of a second set of at least two injectors to reciprocate synchronously as the engine camshaft rotates to impart selectively pressurization energy to fuel trapped within the corresponding fuel pressurizing chambers of said second set of injectors when the pressurizing plungers of said second set of injectors advance and to recover pressurization energy from fuel trapped within said fuel pressurizing chambers when said pressurizing plungers retract, and further including a second interconnecting means for allowing fluidic interconnection of the fuel pressurizing chambers of said second set of synchronized injectors to allow fluidic linkage of the volume of fuel being simultaneously pressurized and depressurized within said interconnected fuel pressurizing chambers of said second set of injectors, said second set of synchronized injectors being out of phase by a predetermined amount with respect to said first set, wherein the total volume of fuel that is fluidically linked together within said second set of synchronized injectors substantially exceeds the volume of fuel injected during each injection event to avoid substantial loss of injection pressure through out each injection event.

39. A fuel injection system as defined in claim 38, wherein each said injector in said second set of injectors includes a nozzle control valve having a closed condition for preventing the flow of fuel into the corresponding combustion chamber and an open condition in which fuel from said second interconnecting means is allowed to flow into the corresponding combustion chamber through the corresponding injection orifice.

40. A fuel injection system as defined in claim 39, wherein each said injector within said second set of injectors further includes a shuttle valve having a closed condition to prevent fuel from flowing from said fuel pressurizing chamber into said second interconnecting means whenever the pressure within said fuel pressurizing chamber is less than the pressure within said second interconnecting means and an open condition to allow fuel to flow from said fuel pressurizing chamber into said second interconnecting means wherever the pressure with said fuel pressurizing chamber is greater than the pressure within said second interconnecting means.

41. A fuel injection system as defined in claim 40, wherein each said nozzle control valve includes a nozzle control valve actuator responsive to an electrical nozzle control valve signal to cause the corresponding nozzle control valve to change between its closed condition and its open condition, and wherein each said pressure control valve includes a pressure control valve actuator responsive to an electrical pressure control valve signal to cause the corresponding pressure control valve to change between its open condition and its closed condition and further including a electronic control electrically connected to said nozzle control valve actuators and said pressure control valve actuators for generating said electrical nozzle control valve signals and for generating said pressure control valve signals at selected times and for selected durations to control the pressure, timing, rate and quantity of fuel injection during each fuel injection event.

42. A fuel injection system as defined in claim 41, wherein said electronic control includes input ports for receiving signals representative of engine operation.

43. A fuel injection system as defined in claim 42, wherein said engine operation signals include at least one or more signals representative of engine position, pressure of fuel in said first and second interconnecting means, desired fueling, desired timing, desired pressure and desired rate.

44. A fuel injection system as defined in claim 43, wherein said pressure control signals and said nozzle control signals are generated to cause the pressure control valves of said first set of injectors to close at selected times to cause the pressure of fuel within said first interconnecting means to reach a pilot injection pressure appropriate for pilot injection through one of said injectors at which time the corresponding nozzle control valve of said injector is opened for an interval to allow a pilot injection from said injector after which said control nozzle valve is closed to allow the pressure of fuel to increase to a main injection pressure higher than said pilot injection pressure at which time said nozzle control valve is again opened for an interval to allow a main injection from said injector.

45. A fuel injection system as defined in claim 44, wherein said pressure control signals and said nozzle control signals are generated by said electronic control in a manner to control the timing, rate, quantity and pressure of a separate pilot and main injection from each injector within said first and second sets to cause the engine to achieve the desired fueling, timing, pressure and shape indicated by the operating signals received by said electronic control.

46. A fuel injection system as defined in claim 45, wherein said pressure control signals and said nozzle control signals generated for the injectors of said first and second sets cause the following independent sequential periods of operation for each injector of said first and second set of injectors:

a. a spilling period when said nozzle control valve is in a closed condition, said pressure control valve is in an open condition and said pressurizing plunger is advancing, b. a pressurizing period when said nozzle control valve and said pressure control valve are both in closed conditions and said pressurizing plunger is advancing, c. a pilot injecting period when said nozzle control valve is in an open condition and said pressure control valve is in a closed condition, and said pressurizing plunger is continuing to advance, d. a dwelling period when both said nozzle control valve and said pressure control valve are in a closed condition and said pressurizing plunger is continuing to advance, e. a low-flow main injecting period when said nozzle control valve is in an open condition and said pressure control valve is in a closed condition and said pressurizing plunger is continuing to advance, f. a high-flow main injecting period when said nozzle control valve is in an open condition and said pressure control valve is in a closed condition and said pressurizing plunger is continuing to advance, g. an over pressurizing period when both said nozzle control valve and said pressure control valve are in a closed condition and said pressurizing plunger is continuing to advance, h. a recovering period when said nozzle control valve is closed and said pressure control valve is closed and said pressurizing plunger is retracting, and i. a filling period when said nozzle control valve is closed and said pressure control valve is open and said pressurizing plunger is retracting.

47. A fuel injection system as defined in claim 46, wherein the pressure control signals and said nozzle control signals generated by said electronic control may cause one or more injectors within either set to be in the pressurization, pilot injecting, dwelling, low-flow main, high flow main or over pressure periods while one or more other injectors of the same set are in the spill period as the pressurization plungers of that set are being advanced.

48. A fluid pressurizing system cyclically imparting pressurization energy to, and recovering pressurization energy from a fluid, comprising a. a source of fluid at low pressure;

b. a plurality of pressurizing units mounted for discharging fluid at high pressure, each said pressurizing unit including;

i. a unit body containing a bore for receiving fluid at low pressure from said source of fluid and a discharge passage in fluid communication periodically with said bore, and ii. a pressurizing plunger mounted for reciprocation within said bore to form a fluid pressurizing chamber from which fluid may be discharged at relatively high pressure;

c. a mechanical linkage for simultaneously reciprocating the pressurizing plungers of a set of at least two pressurizing units as the mechanical linkage selectively imparts pressurization energy to fluid trapped within said pressurizing chambers when said pressurizing plungers advance and to recover pressurization energy from fluid trapped within said fluid pressurizing chambers when said pressurizing plungers retract; and d. a first interconnecting line for allowing selective fluidic interconnection of the pressurizing chambers formed within said first set of pressurizing units to allow fluidic linkage of the volume of fluid being simultaneously pressurized and depressurized within said interconnected fluid pressurizing chambers of said first set of pressurizing units, wherein the total volume of fluid that is fluidically linked together within said first set of synchronized pressurizing units substantially exceeds the volume of fluid discharged during each discharge event;

wherein said first interconnecting line is fluidically connected to said source of fluid and further including a first pressure control valve moveable between an open condition in which fluid is allowed to flow in either direction between said source of fluid and said interconnected fluid pressurizing chambers of said first set of pressurizing units and a closed condition in which energy may be imparted to the fluid within said fluid pressurizing chambers of said first set of pressurizing units as the corresponding pressurizing plungers are advanced and in which energy may be recovered from the fluid within said pressurizing chambers of said first set of pressurizing units as said corresponding pressurizing plungers are retracted, and wherein each said pressurizing unit of said first set includes a nozzle control valve having a closed condition for preventing the discharge of fluid and an open condition in which fluid from said fluidically connected pressurizing chambers of said first set of pressurizing units is allowed to be discharged through a corresponding discharge passage.

49. A fuel injection system as defined in claim 37, wherein each said shuttle valve operates in response to the relative magnitude of three separate fluid pressures including $P_p$ which in the pressure of fuel within the corresponding fuel pressurizing chamber, $P_l$ which is the pressure of fuel in the interconnecting means to which the corresponding injector is connected and $P_m$ which is a reference pressure supplied from a source of reference pressure and further wherein said valve may operate in one of four states, including:

a. a line pressurization state in which $P_m<P_p<P_l$ when said shuttle valve is closed, b. a reset state in which $P_r=P_p=P_l$ and said shuttle valve is closed, c. a energy storage state in which $P_m<P_l<P_p$ and said shuttle valve is open, and d. a energy recovery state in which $P_m<P_p<P_l$ and said shuttle valve is open.

50. A fuel injection system as defined in claim 49, wherein said shuttle valve includes:

a. a valve body containing a valve cavity fluidically connected with said fuel pressurizing chamber, said interconnecting means and said source of reference pressure, b. an outer plunger reciprocally mounted within said valve cavity moveable between a closed condition in which fuel is not allowed to flow between said pressurization chamber and said interconnecting means and an open condition in which fluid is allowed to flow between said pressurization chamber and said interconnecting means, c. an inner plunger mounted within said outer plunger, d. a ball mounted to normally close fuel communication between said valve cavity and said source reference pressure, and e. a spring for biasing said inner plunger into contact with said ball and for biasing said outer plunger toward its closed position, wherein said outer plunger contains a plunger cavity which is offset with respect to said ball to cause said ball to be moved laterally as said outer plunger moves toward its open position.

51. A fuel injection system as defined in claim 49, wherein said shuttle valve includes:

a. a valve body containing a valve cavity fluidically connected with said fuel pressurizing chamber, said interconnecting means and said source of reference pressure, b. a plunger reciprocally mounted within said valve cavity movable between a closed condition in which fuel is not allowed to flow between said pressurizing chamber and said interconnecting means and an open condition in which fluid is allowed to flow between said pressurization chamber and said interconnecting means, and c. a semi-spherical valve element containing an angled passage for normally residing in a closed position blocking communication between said valve cavity and said source of reference pressure, but moveable to an open position in which said angled passage is realigned to cause fluid communication between said valve cavity and said source of reference pressure, wherein said plunger and said spherical valve element have contact surfaces shaped to cause said semi-spherical valve to move to its open position when said plunger moves toward its open position.

* * * * *